US005203316A

United States Patent [19]

Pritchett

[11] Patent Number: 5,203,316

[45] Date of Patent: Apr. 20, 1993

[54] PORTABLE CAMP STOVE

[76] Inventor: Wayne Pritchett, 4075 Lasalle Ave., Culver City, Calif. 90230

[21] Appl. No.: 794,675

[22] Filed: Nov. 18, 1991

Related U.S. Application Data

[63] Continuation of Ser. No. 487,727, Mar. 6, 1990, abandoned, which is a continuation of Ser. No. 194,951, May 17, 1988, abandoned, which is a continuation-in-part of Ser. No. 839,158, Mar. 13, 1986, Pat. No. 4,744,381.

[51] Int. Cl.[5] ..... F24B 3/00

[52] U.S. Cl. ..... 126/29; 126/30; 126/9 R; 126/15 R; 126/58; 126/59; 126/77; 126/25 R

[58] Field of Search ..... 126/9 R, 15 R, 29, 58, 126/59, 77, 25 R, 25 A, 30

[56] References Cited

U.S. PATENT DOCUMENTS

| | | | |
|---|---|---|---|
| 33,995 | 12/1861 | Johns . | |
| 34,433 | 2/1862 | Lambert . | |
| 485,049 | 10/1892 | Marcee | 126/59 |
| 875,216 | 12/1907 | Rudmann . | |
| 1,780,068 | 10/1930 | Dorman . | |
| 2,414,147 | 1/1947 | Fleer | 126/15 R |
| 3,292,609 | 12/1966 | Powell . | |
| 4,471,751 | 9/1984 | Hottenroth et al. | 126/15 R |

*Primary Examiner*—Carroll B. Dority
*Attorney, Agent, or Firm*—Lane, Aitken & McCann

[57] ABSTRACT

A portable camp stove is disclosed. It consists of a frusto-conical main body, a preheating chamber, and spiral flue chambers. The stove may be placed over a fire in a pit in the earth, or the stove may completely contain a fire within it when its bottom plate and legs are attached. Other accessories of the stove include a stovepipe and oven combination, a water heating system, and a grill and a rotisserie.

18 Claims, 16 Drawing Sheets

92
90
510
514
420
528
531
522
520
526
532
524
512
426
364
362
358
324
388
530
534
536

PORTABLE CAMP STOVE

This application is a continuation of application Ser. No. 07/487,727, filed Mar. 6, 1990 now abandoned, which is continuation of application Ser. No. 07/194,951, filed May 17, 1988, now abandoned, which is a continuation-in-part of application Ser. No. 06/839,158 filed Mar. 13, 1986, which has been allowed and issued as U.S. Pat. No. 4,744,381.

BACKGROUND OF THE INVENTION

The use of open fires for cooking, light and warmth has been traced back to the early days of humankind, but for as much as fire brought, in today's world it leaves a few things to be desired.

First, open fires typically burn unevenly, preventing uniform cooking and heating. Second, for cooking, open fires do not utilize efficiently the heat generated because of significant losses to the surroundings. Third, the environmental elements must be contended with whenever the fire was built. For example, rain or snow could extinguish the fire. Moreover, winds could make it difficult to start or sustain a fire. Wind-blown smoke and ash also may be quite problematic. Additionally, open fires may be driven out of control by winds.

Enclosing a fire within a standard stove eliminates these drawbacks, but introduces other difficulties. For example, stoves are typically large and bulky, being designed for use in permanent and semi-permanent locations. Standard stoves are also not airtight, are not versatile, contain no preheating apparatus, and are not efficient. And while portable stoves are available, they often have quite limited cooking surfaces and are not designed for space heating. Furthermore, other portable stoves may require dangerous or expensive fuels which must be transported by the user of the stove.

SUMMARY OF THE INVENTION

To overcome the above-stated disadvantages, the present invention provides a stove with several unique features designed for efficiency, versatility, portability and aesthetics.

The stove features a system of compound spiral flue chambers which can provide continuous heat for space heating as well as cooking, and which is airtight, efficient, easily compactable and portable.

In addition, the stove's unique versatile structure allows use of its various components in several configurations promoting lightweightness, safety and portability without reducing its efficiency. For example, the stove may be used with or without a bottom, with or without legs, with or without the compound flue chambers, or for conventional stove top cooking, baking, grilling, or barbecuing.

Also, the stove provides an improved reinforcement system featuring corrugated metal channel forming rim, metal bars, bands and plates as structural enhancements to protect the stove from heat distortion and fatigue, while adding minimal weight. Furthermore, numerous design features, such as the stove's conical shape, preheating channel and no bottom mode, also prevent warping.

DETAILED DESCRIPTION OF THE PREFERRED EMBODIMENTS

Figure 1:
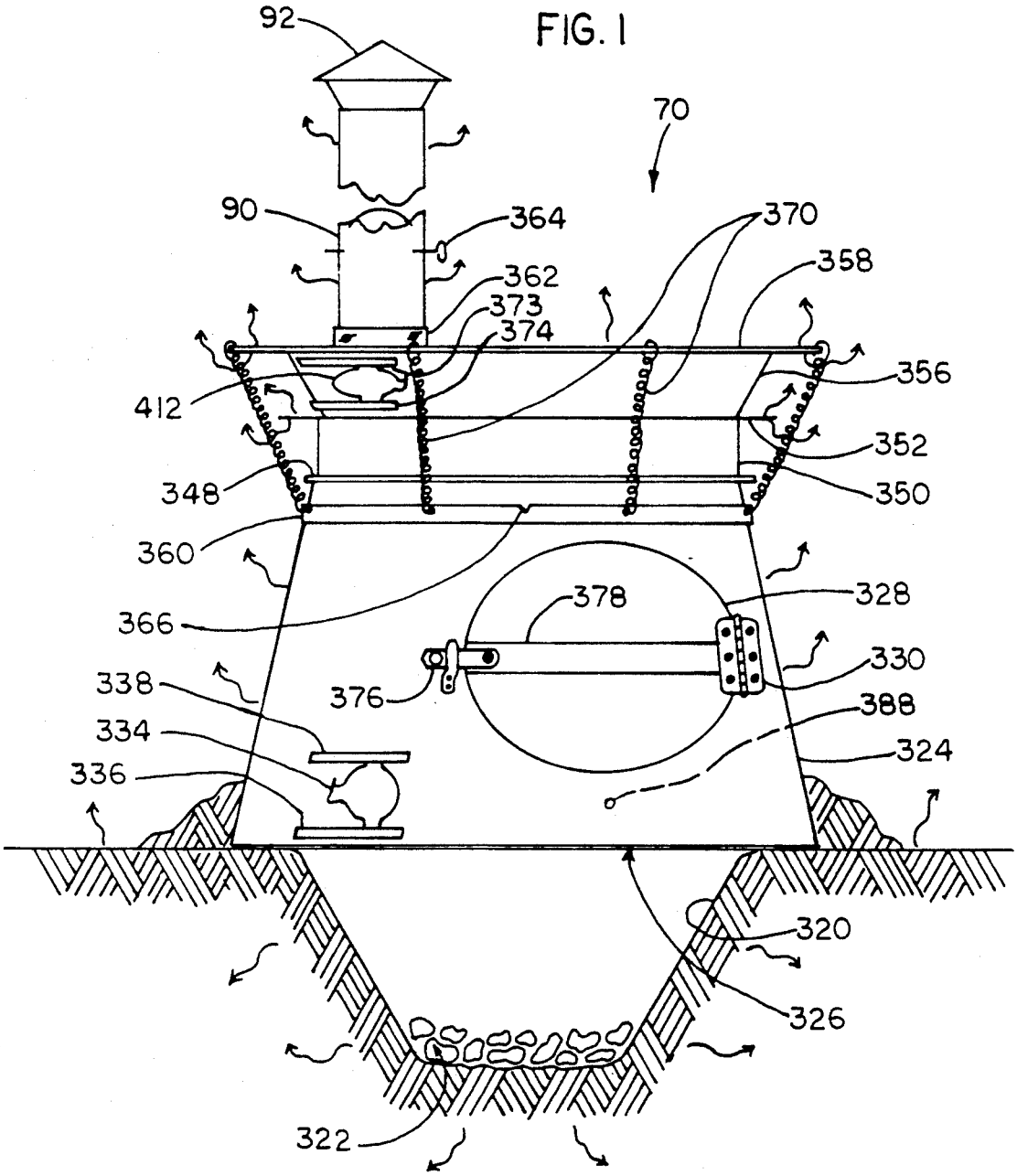
FIG. 1 is a perspective view of the stove without a bottom.

The present invention is a portable lodge camp stove, a preferred embodiment which consists of a partial, conical main body 324, having an open bottom 326, and is depicted in perspective in FIG. 1. The design of stove 70 offers many features and advantages not found in any other camp stove. The stove is airtight, efficient, lightweight, compactable, portable, versatile, and aesthetically pleasing. The stove allows optimum heat efficiency per unit of fuel and eliminates inefficient, smokey fires. The heat radiating qualities of the stove are depicted by arrows in FIG. 1. The stove is useful in many situations, and can be used in many different modes, but especially for permanent or semi-permanent camp living, and for winter and arctic camps, work camps, expedition base camps, as well as for public and private park and camp grounds, and residential backyards.

The inventive concepts of the stove are suitably employed in several different models, sizes, and weights to best suit different requirements or purposes, such as for very lightweight travel, for different volume shelters to be heated, or for the number of people to cook for, etc. A miniature size is made for backpacking which has the advantages over a gas stove in that it provides more heat, and that heavy, dangerous fuel need not be carried. A relatively large embodiment of the stove is adapted for use in a cabin or house. The stove is also suitable for use anywhere outside, such as in picnic areas or public campgrounds, where it is much more efficient, safe, and resistant to the elements than an open fire. When the main body sits directly on the ground as it does in this no bottom mode, air tightness is achieved in the primary combustion chamber by back filling and lightly packing dirt about 3 inches up all around the base of the stove.

One significant inventive feature of stove 70 is the absence of a bottom. This feature allows the stove to be lighter and also permits utilization of the earth. In using the ground as the bottom, a fire is placed at the lowest elevation, aiding in the prevention of a cold air layer forming on the floor of the lodge. This cold air layer phenomenon is completely prevented by drawing the combustion air from the exterior of the lodge and by sealing the bottom periphery of the lodge.

The fire chamber defined in this fashion will accommodate logs up to 18 inches long and 4 inches thick. Logs of an ideal size for easy handling in the depicted embodiment would be 12 inches in length, and a maximum size would be 20 inches long and 6 inches thick.

Figure 2:
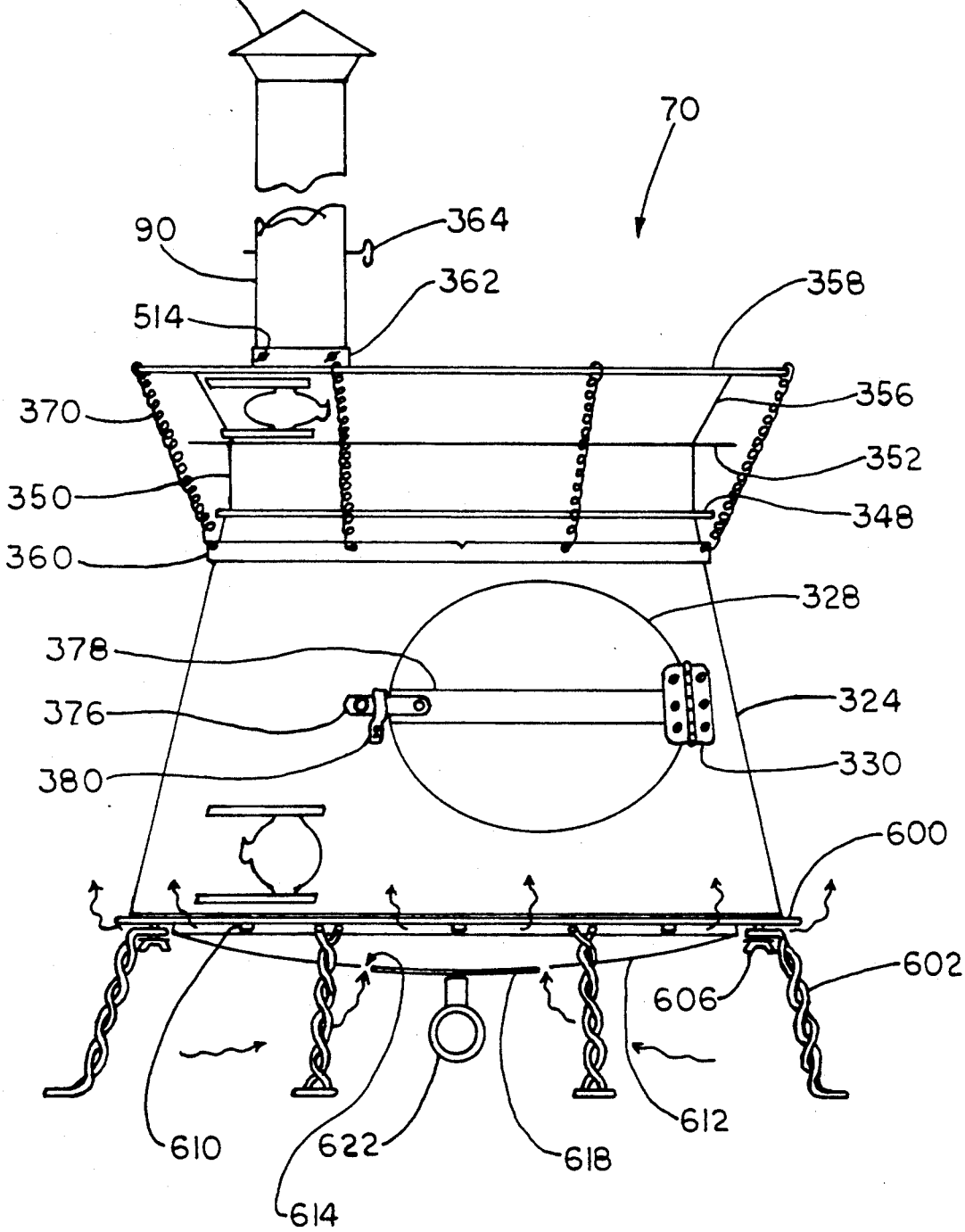
FIG. 2 is a perspective view of the stove in FIG. 1 with associated bottom and legs.

The elimination of a stove bottom also allows the fire to heat the ground to make it warmer and drier and to store heat for late evening release. To increase this advantage, especially in winter and more permanent camps, a ground pit 320 is dug. The ground pit is 9 inches deep, 18 inches in diameter at its top, and 8 inches in diameter at its bottom. The stones 322 in pit 320 are approximately 3 inches deep, such that the distance from the bottom plate 348 which is depicted in FIG. 2 to the top of the stones is approximately 20 inches. This ability to use a ground pit affords additional advantages, including the enlargement of the combustion chamber's capacity, the extension of the expected life of the stove's metal, and the maintenance of a readily accessible hot water supply without taking up space on the cooking surface.

Ground pit 320 is provided in one embodiment to enlarge the primary combustion chamber's capacity and also to put the fire into the ground, so that the earth walls of the pit take the brunt of the heat, rather than the metal of main body 324, thus helping to conserve the metal from heat fatigue. This is especially advantageous for long winter camps when intense fires are burned for long periods, and it also keeps the ground warmer and drier.

As noted above, in one embodiment the bottom of pit 320 is filled with about three inches of rocks 322. If the nature of a particular soil type causes pit 320 not to hold its shape, the side walls may be lined with rocks, and in this case the pit is dug a little wider and dirt is packed down around the top edge, so that the base of the stove sits firmly without air leakage. To ensure that the stove's bottom sits firmly and evenly on loose soil, flat rocks are placed underneath as necessary.

Other major inventive features of the stove include the compound spiral flue chambers and the ability of the stove to be used with legs and a bottom, as well as to be disassembled and made compact for transport. These and other advantageous aspects, including the operation and use of the stove, are further described herein in connection with the drawings.

Figure 3:
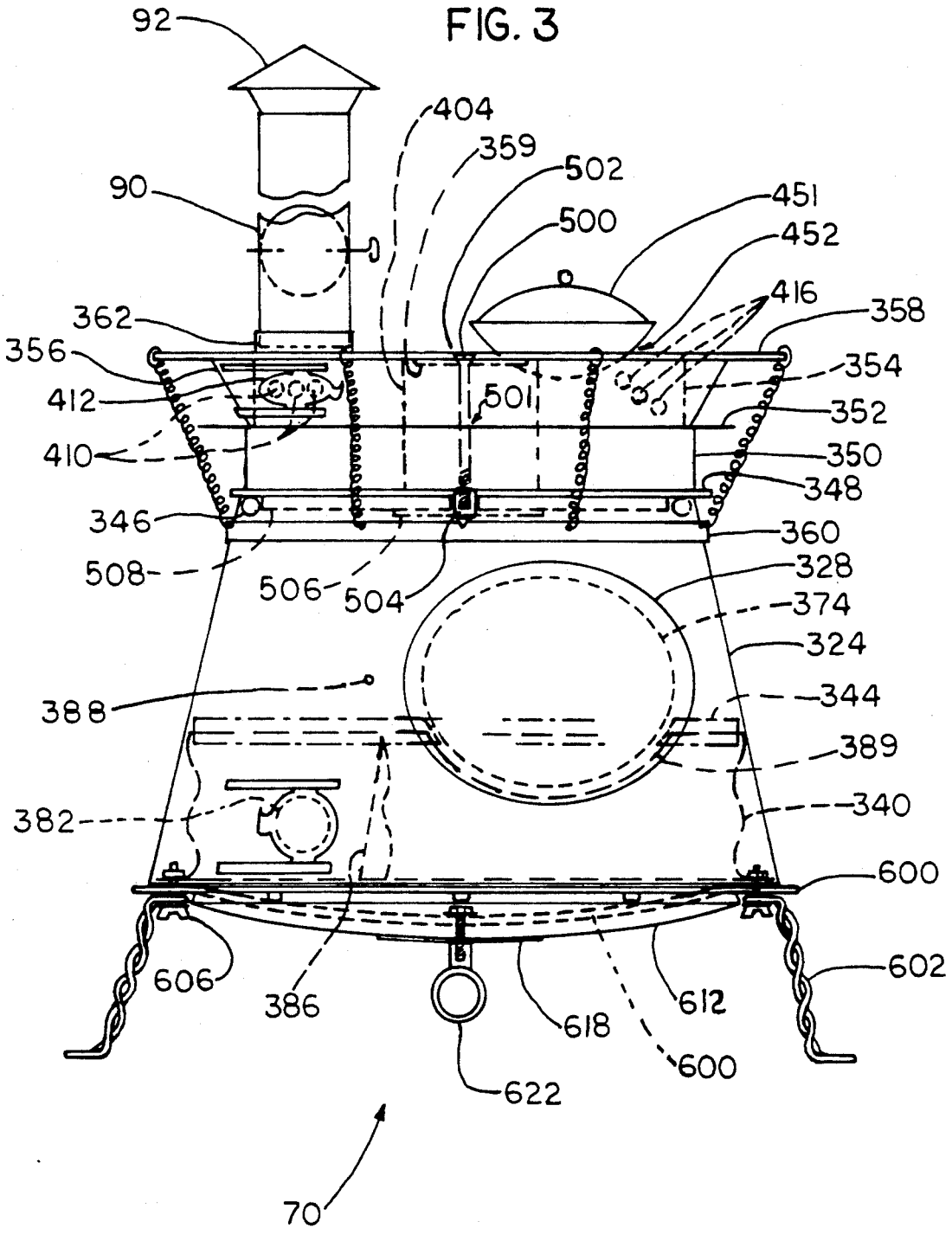
FIG. 3 is a front view of the stove of FIG. 2 with some parts shown in phantom.

FIGS. 2 and 3 illustrate stove 70 with a bottom assembly, legs and some of the parts depicted in phantom. The bottom assembly and legs will be discussed in greater detail below. The oval shape of the wood feeder door enlarges the horizontal access of the door so as to allow one to feed logs into the stove in an easier fashion, and also to allow one to manipulate logs already in the stove in an easier fashion. The oval-shaped wood feeder door 328 is disposed in the main body and is provided with hinge 330 and latch 376. Rounded primary air inlet sliding door 334 is also provided in main body 324 and slides on guide rails 336, 338. In phantom, primary air preheater channel rim 340 is depicted, as well as optional preheater channel rim retainer rim 344 in FIG. 3. Also illustrated in FIG. 3 is a wok pan which protrudes into the upper spiral flue chamber. This allows for the hot circulating flue gases to flow directly around the bottom of the wok pan.

Main body key rim 346, depicted in phantom in FIG. 3, keys into the top of main body 324. Above rim 346 is bottom plate 348, lower-gas containing rim 350, which contains compound spiral flue chambers, middle plate 352, and upper gas-containing rim 354, shown in phantom, which also contains spiral flue chambers. Secondary air preheater channel 356 is disposed above rim 354. Oval-shaped secondary air inlet door 412 is disposed in the secondary air preheater channel and slides on guide rails 373. Springs 370 attach at one end to top plate 358 and at another end to main body reinforcement rim and spring catch 360. Alignment groove 366 simplifies alignment of bottom plate 348 with main body 324.

Flue screw 500 facilitates vertical alignment of the plates 348, 352 and 358, assists in preventing warping of the plates and helps achieve airtightness by pressure connecting the three compound spiral flue chamber plates. Flue screw 500 first passes through top plate 358 via a beveled hole 502. The beveled hole 502 allows the screw to fit flush with the cooking surface of the stove. The screw passes through reinforcement plate 359 which is spot-welded below the top plate 358. A $\frac{3}{8}$ inch diameter hole 501 in middle plate 352 accommodates the flue screw as it extends toward the bottom plate 348. A coupling socket 504 is welded to bottom plate 348 to receive the flue screw.

Main body 324 forms the side walls of the primary combustion chamber. It has a partial conical cylindrical shape for stability, and permits all of the stove's pieces to be compactly stowed away inside for convenient transport, as will be described hereinafter. It is composed of approximately 1/16 of an inch thick, flat, sheet metal.

Figure 4:
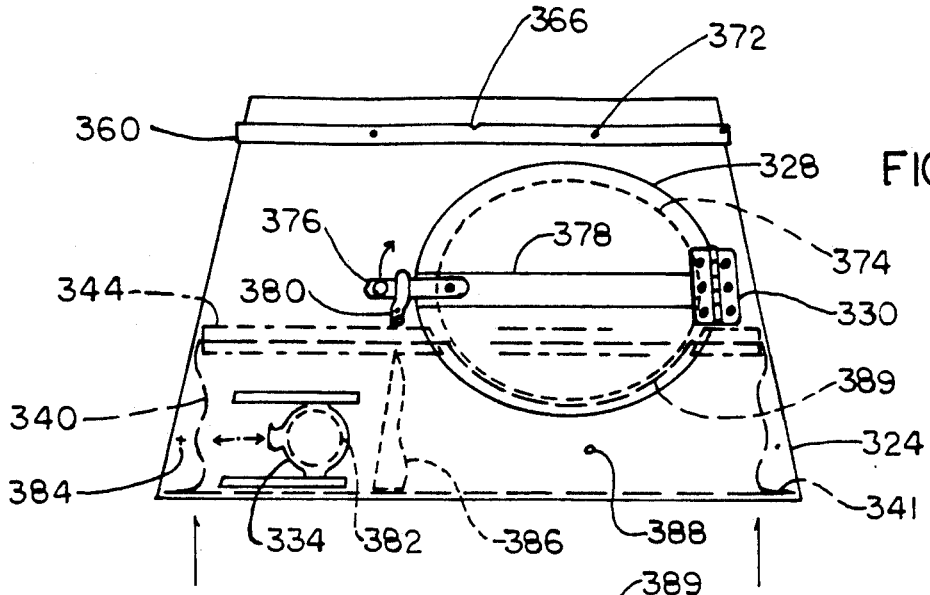
FIG. 4 is a front view of the main body of the stove in FIG. 1.

Several reinforcements are made to aid in the prevention of heat warping. First, there is the reinforcement rim 360 that is welded to the main body just above door 328. In the depicted embodiment, rim 360 is 1 inch wide, 3/32 inches thick, and 2¼ inches down from the top edge of main body 324. Rim 360 is also used to hook the springs connecting the upper plate to the main body and has holes 372 as depicted in FIG. 4 equally spaced apart, into which the springs are hooked. In the depicted embodiment, there are six holes having diameters of 3/32 of an inch. Second, there is pipe 346 which is 1 inch in diameter and fits against the inner circumference of the top of the main body 324. In the depicted embodiment, the pipe is welded underneath the plate and forms a circle 17 inches in diameter, the same diameter as the top opening of main body 324. By fitting snugly against the inner circumference of the top of the main body, the pipe helps retain the round shape of the main body. Reinforcement rim 344 is also provided in a preferred embodiment. It is, in the depicted embodiment, 1 inch wide and welded to the main body, and supports preheater channel rim 340. Reinforcement rim 344 is continuous about an annular inner surface of body 324, except where the surface intersects with door 328. Other means of reinforcement for the main body are described below.

Opening 374 that is covered by door 328 is provided for the insertion of firewood. The raw edge of this cutout is curled in order to help keep its shape. Door 328 covers and closes this hole and is hinged to one side, as stated above. The hinge is slightly out of plumb so the door will stay in the open position until closed manually. Around the inside edge of the door 328 is an insulating fiber strip to seal the door and make it airtight. A swivel latch locking handle 376 is mounted on door 328 at the end of reinforcement strap 378, and locks with friction pressure at catch 380, which is mounted on the main body. The reinforcement strap, in the depicted embodiment, is 1 inch wide and welded to door 328.

There is also a primary combustion air-intake hole 382 with a siding volume-control door 334 on the side of the main body, just to the left of wood feeder door 328. See FIG. 4. Additional combustion air can be obtained by cracking open door 328, especially when first starting the fire, and until a sufficient draft is obtained. In the depicted embodiment, air-intake hole 382 is ½ of an inch by 3½ inches.

Figure 5:
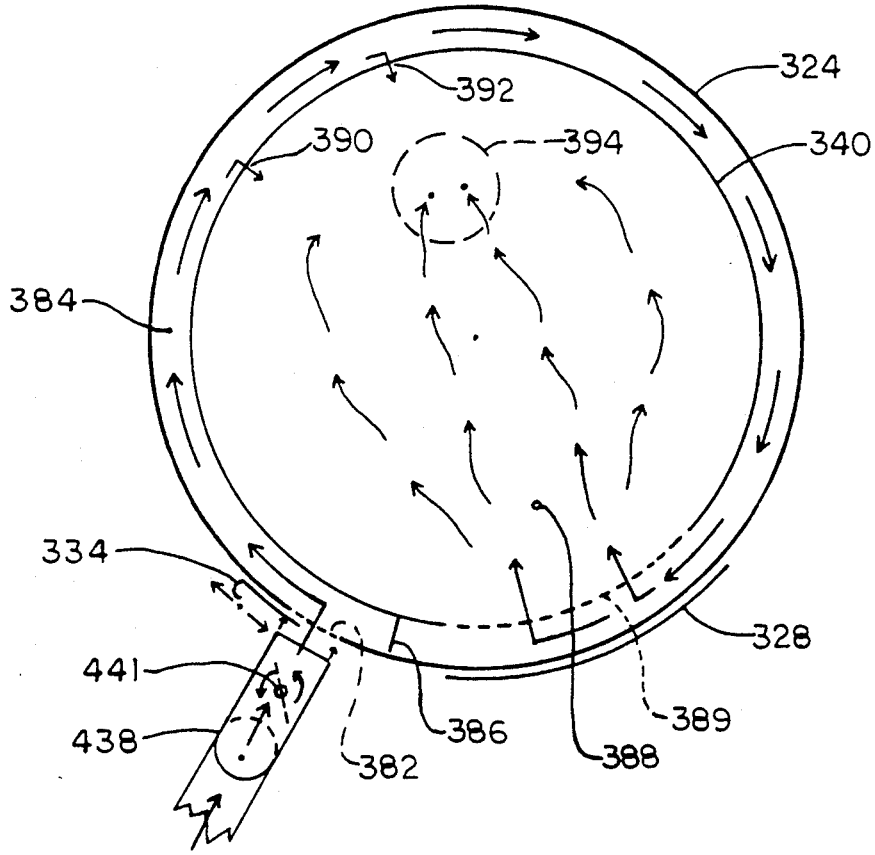
FIG. 5 is a bottom view of the main body of the stove of FIG. 4, including an associated air channel.

In one embodiment, the primary combustion air intake is from primary air inlet hole 382, which is cut into the side of main body 324 near its base. As discussed above, the hole is covered with a sliding door 334 to control the volume of air. Heating the incoming cold, oxygenated fresh air is of prime importance to achieving and maintaining an efficient combustion temperature for a complete and clean burn. To accomplish this, an inventive air preheater channel is formed by inserting into the inside of the main body primary air preheater channel rim 340, as depicted in FIG. 4. In the illustrated embodiment of FIGS. 3 and 4, rim 340 is 5⅞ inches high, and 3/32 of an inch thick. The metal is corrugated with alternating curved surfaces to prevent warping. The top edge of rim 340 fits snugly against the main body's conical wall, thus forming a completed annular channel 384, as depicted in FIG. 5. In addition, a flange 341 encloses the bottom edge of the rim 340, fitting snugly against the base edge of the main body, to create an airtight primary air preheater channel 384. See FIGS. 5 and 6. Further advantages of the flange are that it prevents the rim, when used alone, from sinking into soft ground, blocks flames from entering the preheating channel, helps prevent warping of the main body, and receives bolt which is used to attach the barbecue.

FIG. 4 illustrates the round air intake hole 382, air intake control door 334, and wood feeder door 328. The flow about channel 384 is blocked by a triangular piece of sheet metal 38 which is disposed just to the right side of air intake hole 382. See FIG. 5. In this fashion, incoming air is caused to circulate in only one direction, clockwise around the channel, according to the correalus force. As the cold air circulates in contact with the metal of channel rim 340, as well as main body 324, a sufficient distance is traversed so that the circulating air temperature is raised substantially before its introduction into the combustion chamber 388, thereby assuring the maintenance of high combustion temperatures, even on the coldest days.

Figure 6:
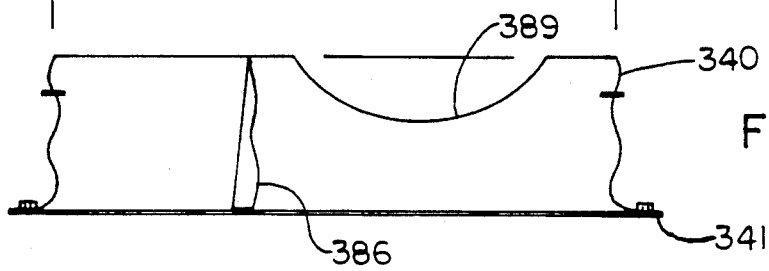
FIG. 6 is a side view of a wall of the channel in FIG. 5.

The introduction of the heated air into combustion chamber 388 occurs mainly at the wood-feeder door 328, where channel rim 340 is provided with cut-out 389 to accommodate the door's opening as shown in FIG. 6. Since door 328 is disposed just to the right of sheet metal block 386 as shown in FIG. 5, this arrangement requires the incoming air to travel the greatest distance through channel 384. The arrows in FIG. 5 indicate the entrance and exits of pre-heated air before entering the combustion chamber. In FIG. 5, the arrows which indicate the flow of air terminate at opening 394 which is in such a location in the chamber as to require the preheated air to travel the furthest distance across the center of the combustion chamber. The round entrance hole for the air at 382 is designed to receive an exterior air inlet adapter section which will be described later in the description associated with FIG. 19. In addition, holes 390 and 392 are strategically placed on channel rim 340 in order to achieve an even distribution of the oxygenated air. Rim 340 takes the brunt of the heat and is much easier to replace, when required, than main body 324. In this way, the metal of the main body is conserved. To further prevent channel rim 340 from bulging or warping and prematurely releasing its air into the fire, retainer and reinforcement rim 344, as shown in FIG. 4, is welded to the inside of the main body where channel rim 340 contacts the wall of the main body 324. Rim 344 is suitably 1 inch wide.

Two layered, circular, substantially horizontally disposed flue chambers sit one on top of the other and on top of main body 324, as depicted in FIG. 2. The chambers are formed by three plates 348, 352 and 358 and two gas-containing rims 350, 354 stacked on top of one another, with plate 348 being the ceiling for primary combustion chamber 388, and plate 358 forming the cooking surface. The plate and rims are attached to main body 324 under pressure by springs 370 which are equally spaced and hooked to top plate 358, and to reinforcement rim 360. The firm pressure of the springs close any gaps in the joints between the plates and rims, assuring a tight seal. The gas-containing rims and pipe 346 are spot-welded to the undersides of the plates to maintain their centered positions. Thus, as depicted in FIG. 7, circular pipe 346 is spot-welded to the bottom of plate 348, which is provided with hole 394.

Figure 10:
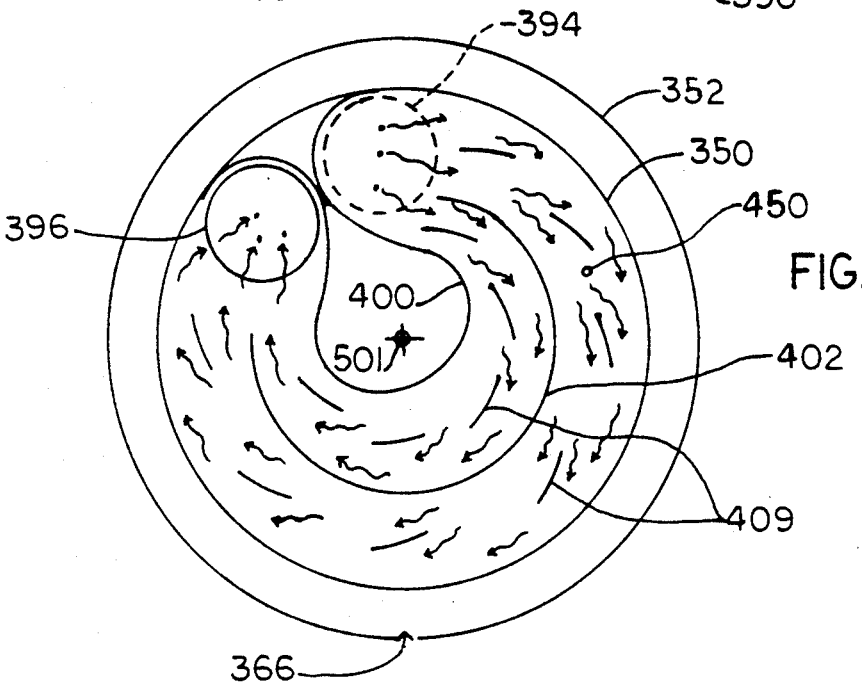
FIG. 10 is a bottom view of the lower flue chambers for a second plate with associated baffles and air channels with arrows indicating circulation.
Figure 11:
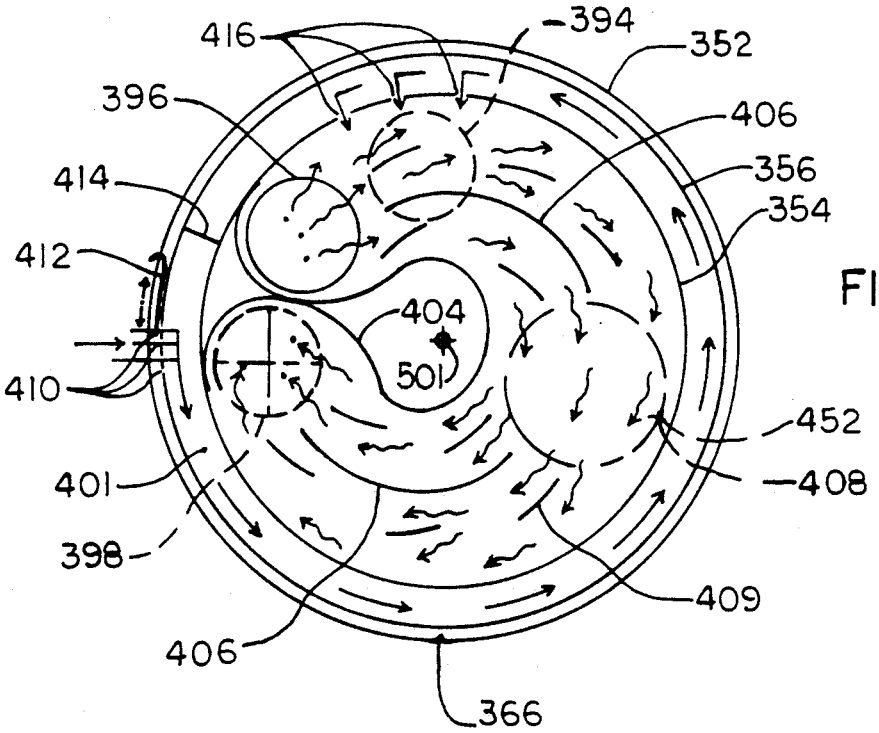
FIG. 11 is a bottom view of the upper flue chambers for the second plate in FIG. 10, with associated baffles and air channels, with arrows indicating circulation.

The compound spiral flue chambers are depicted in greater detail in FIGS. 10 and 11. FIG. 10 is a bottom view of the underside of the flue chamber's middle plate assembly of FIG. 12. In the center of the middle plate is provided a ⅜ of an inch hole 501 to accommodate the flue screw and also while in the transport mode to accommodate the carrying handle tie rod. Additionally, welded to the middle plate between the gas baffle and gas containing rims are attached a series of gas deflecting blades to further assist the outwardly spiral of flue gases as depicted by the arrows in the figure. FIG. 11 is a bottom view of the top side of the flue chamber's middle plate assembly of FIG. 12. This middle plate also has a ⅜ of an inch hole in the center of the plate at 501, the gas deflecting blades, and the arrows which indicate the circulation of the incoming preheated air.

Figure 8:
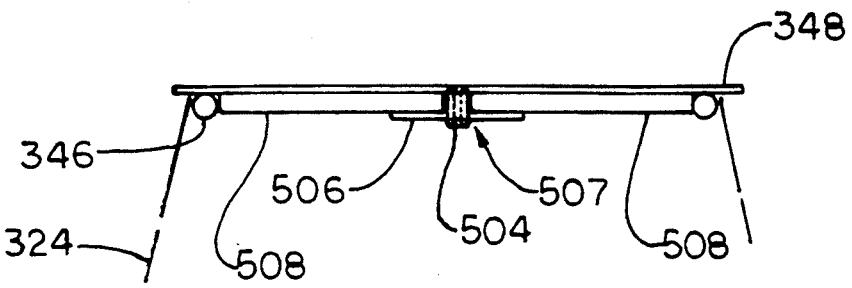
FIG. 8 is a side view of a first plate, U-channel reinforcement bars, reinforcement plate and pipe assembly.
Figure 7:
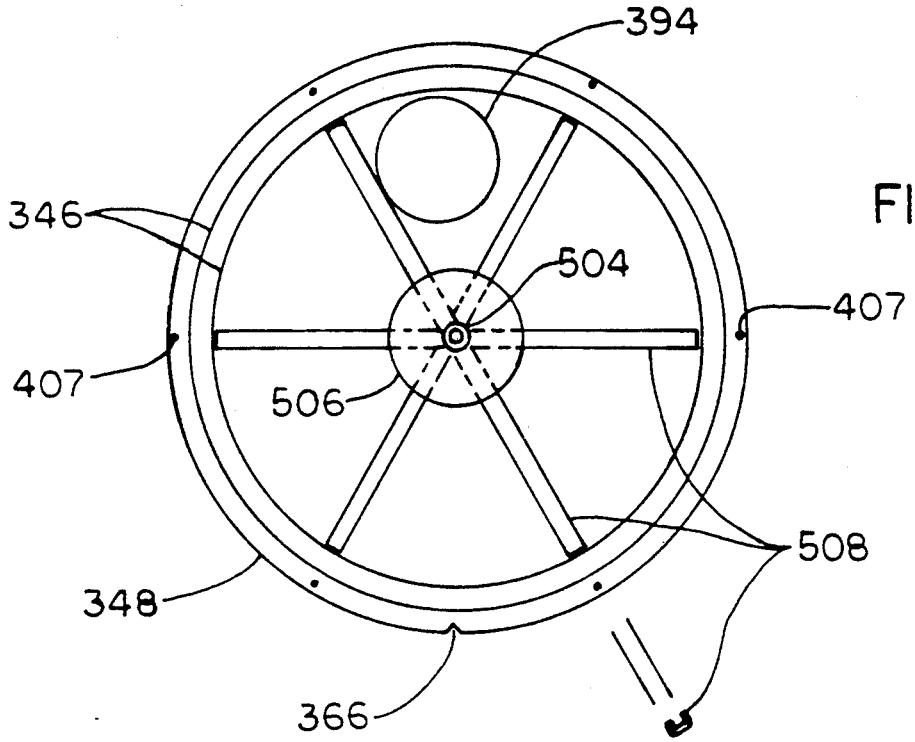
FIG. 7 is a plan view of the first plate and reinforcement assembly.
Figure 9:
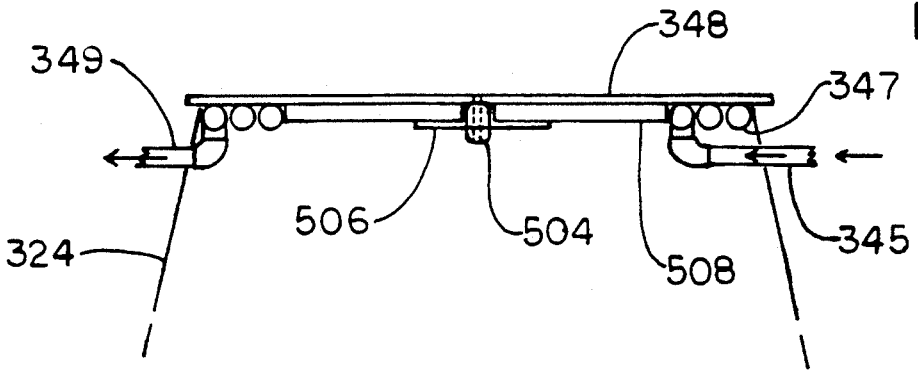
FIG. 9 is a side view of a coiled pipe alternative to FIG. 8.

The bottom plate 348 is also rigidified by six U-channel iron bars 508 to prevent warping as depicted in FIGS. 7 through 9. Welded to the underside of the bottom plate 348, the bars 508 radiate from the center of plate. Note also the alignment marker groove at 366 which aligns the base plate with the main body. Also depicted in FIG. 7, are the six 1/16 inch holes 407 drilled equidistant around the perimeter edge of the plate. These holes receive flue connecting springs while in the transport package mode.

As depicted in FIG. 8, a plate 506, six inches in diameter and ⅛ of an inch thick, is welded to iron bars 508 to provide additional reinforcement. A center hole 507 in plate 506 accommodates the coupling socket 504 for flue screw 500. This construction enhances dimensional stability of the bottom plate which is exposed to the high temperatures of the fire, while minimizing added weight. A one piece circular pipe 346 is welded to the underside of base plate 348 to further help prevent warping and buckling of the flue base plate. This circular pipe is sized to clip down snugly into the top opening of the main body. It is pressure fitted to the main body's wall so as to tightly seal out air leaks, and it also functions to maintain the round shape of the main body's wall. The roundness of the pipe helps to locate and center the base plate for easy placement. A hole is drilled into the center of the base plate 348 to house a 5/16 of an inch threaded coupling 504 which is welded to the base plate and also welded to channel irons conversing into the center. Then, as mentioned previously, the ⅛ of an inch thick 6 inch diameter plate 506 provided with a center hold is welded to threaded coupling and channel irons for reinforcement. This threaded coupling is meant to receive the flat head flue screw which pressure connects the three flue chamber plates to prevent warping of plates and seal from air leaks. Also this coupling is meant to receive in the transport package mode the poker rod which serves as a tie rod for the transport carry handle tying or joining the base plate and top flue plate or the stove bottom also. This is depicted better in FIGS. 27 and 32 which we be described later.

FIG. 9 depicts an alternative embodiment of the bottom plate 348 where instead of a single circular pipe 346 for reinforcement, a coil of pipe 347 is welded underneath the bottom plate. Taking advantage of the plate's location at the ceiling of the primary combustion chamber, the coil pipe 347 may be used as part of a hot water or steam generation system. Water entering at the pipe's inlet 345 is heated as it circulates through the coil, exiting at the pipe's outlet 349. In more advanced cabins or house stove models, this embodiment could include a simple steam turbine for electricity generation.

As depicted in FIG. 10, lower rim 350 is spot-welded underneath the bottom of middle plate 352. FIG. 11 shows upper rim 354 spot-welded underneath the bottom of top plate 358. Opening 396 is provided in plate 352.

In use, hot wood gases from the primary combustion chamber rise up through the series of holes cut into the plates. In the depicted embodiment, the holes are five inches in diameter. The gas spirals twice clockwise, with the assistance of the correalus force, in the flue chambers and is guided by baffles 400, 402, which are spot-welded to the bottom of middle plate 352, and baffles 404, 406, which are spot-welded to the top of middle plate 352. An additional series of baffles 401 assist the outward spiral of flue gases, thus prolonging the gases' residence time within the primary combustion chamber. Baffles 400, 402, 404, 406 and 401 have a depth of 2½ inches in the depicted embodiment. Opening 394 of rim 348 is depicted in FIGS. 10 and 11 to indicate the origin of the gases circulating within rim 350 and the origin of the gases that circulate within rim 354. After the gases circulate, as indicated by the arrows in FIGS. 10 and 11, they exit to the stovepipe through hole 398 (see FIG. 15).

The layered flue chambers cause the heat of the primary combustion chamber to heat the spiralling gases, thus maintaining their high temperatures with the lower flue chamber continuing to heat the chamber above. Accordingly, the addition of other layered flue chambers is within the scope of the invention. The flue chambers enable the retention of the gases long enough to achieve completed burn of the gases, and also permit time for the extraction of the heat.

Since there is a tendency for the rising, spiralling gases to take the shortest path possible on their trip up and around the chambers generally defined by rims 350 and 354, the baffles are used to guide the gases into the longest indirect path possible to extend thereby the residence time of the heated gases. It is within the scope of the present invention to align these baffles differently and/or to add additional baffles for optimum effect in directing the gases into the longest path possible.

Figure 12:
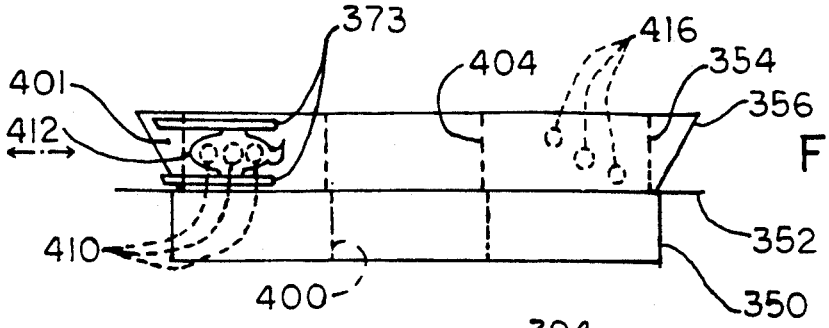
FIG. 12 is a side view of walls of the channels of FIGS. 10 and 11.

The secondary combustion air and preheater channel 401 is depicted in more detail in FIGS. 10 and 11. To assist in the complete burn of the gases, preheated secondary air is introduced from this channel into the second level flue chamber. This is accomplished by adding secondary air preheater channel rim 356 to upper gas-containing rim 354. The additional flat sheet metal rim, in the depicted embodiment, has a 60-degree angle to it, so that circular channel 401 is formed. As illustrated in FIG. 12, three round holes 410 are strategically cut into this angled rim, through which oxygenated fresh air enters the channel. Oval sliding door 412 disposed over this hole controls the volume of air allowed to enter. As illustrated in FIG. 11, channel 356 is blocked off by sheet metal block 414 at a point to one side of holes 410, causing the air to move in only one direction around channel 401.

Interior gas-containing rim 354 is also provided with round holes 416 in order to introduce fresh, preheated air into the flue chambers' spiralling hot gases to achieve secondary combustion of any gases not yet combusted. Holes 416 are made at a point where the rising gas enters the flue chamber from hole 396 in middle plate 352. The long path around preheater channel 401 allows the cold air entering to be heated by the metal rims to temperatures near those necessary for combustion to occur, resulting in minimal cooling of the spiralling gases in the flue chamber.

Figure 15:
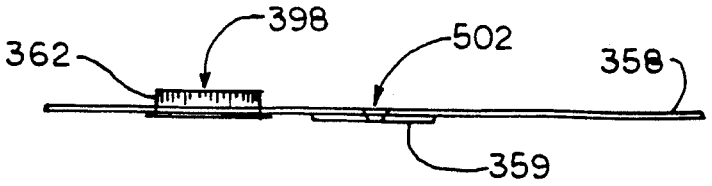
FIG. 15 is a side view of the third plate showing the smokestack connector and reinforcement plate.
Figure 13:
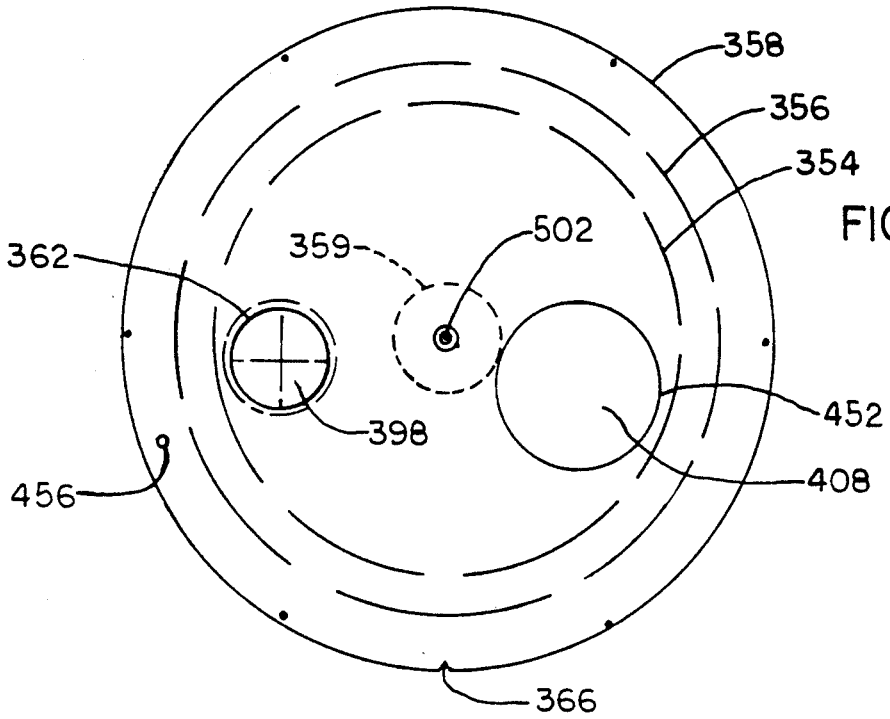
FIG. 13 is a plan view of a third plate showing smokestack location and cooking surface.
Figure 14:
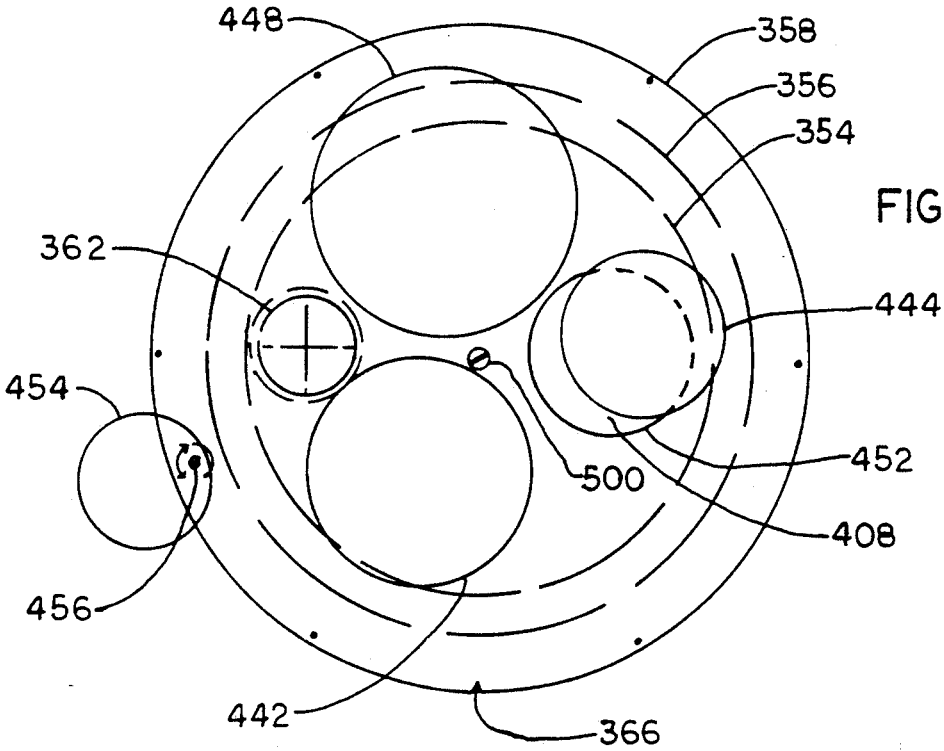
FIG. 14 is a plan view of an alternative cooking surface.

The cooking surface is depicted in FIGS. 13 through 15. Top plate 358 provides a cooking surface sufficient to accommodate several large pots as evidenced by openings 442, 444, and 448. The circulating hot gases of the flue chamber, just underneath top plate 358, heat fairly evenly an area 18 inches in diameter in the depicted embodiment, less the area occupied by stovepipe joining flange 362, sufficient to accommodate a 10-inch, 8-inch and 6-inch pot. The hottest spot 450, depicted in FIG. 10, is where gases enter the fire chamber just to the right of the smokestack and where the secondary combustion gas is introduced. The outer edge of the cooking surface is the coolest. Regulation of cooking temperatures is accomplished both by the location of the pots and by regulating the intensity of the fire itself.

As depicted in FIG. 14, a 7-inch hole cutout 408 with removable cover 452 is provided for a frying pan. This open hole permits heating directly with the spiralling hot gases. The top surface also may be used directly as a griddle. Additional space is provided in one embodiment by a disk 454. In a preferred embodiment, disk 454 has a 7-inch diameter, swivels out about pivot point 456 when needed and is affixed by a swivel bolt and butterfly nut. It is conveniently used as a warmer plate and is removable for transport.

Reinforcement plate 359 is welded beneath top plate 358 to assist in prevention of warping, as shown in FIG. 15. Further illustrated by FIG. 15 is a 5/16 of an inch hole at 502 which is provided in the center of the top plate and has beveled edges to receive and seat the head of the flat headed flue bolt. Underneath this is welded a ⅛ of an inch thick 4 inch diameter reinforcement plate 359.

Figures 16, 17, 18:
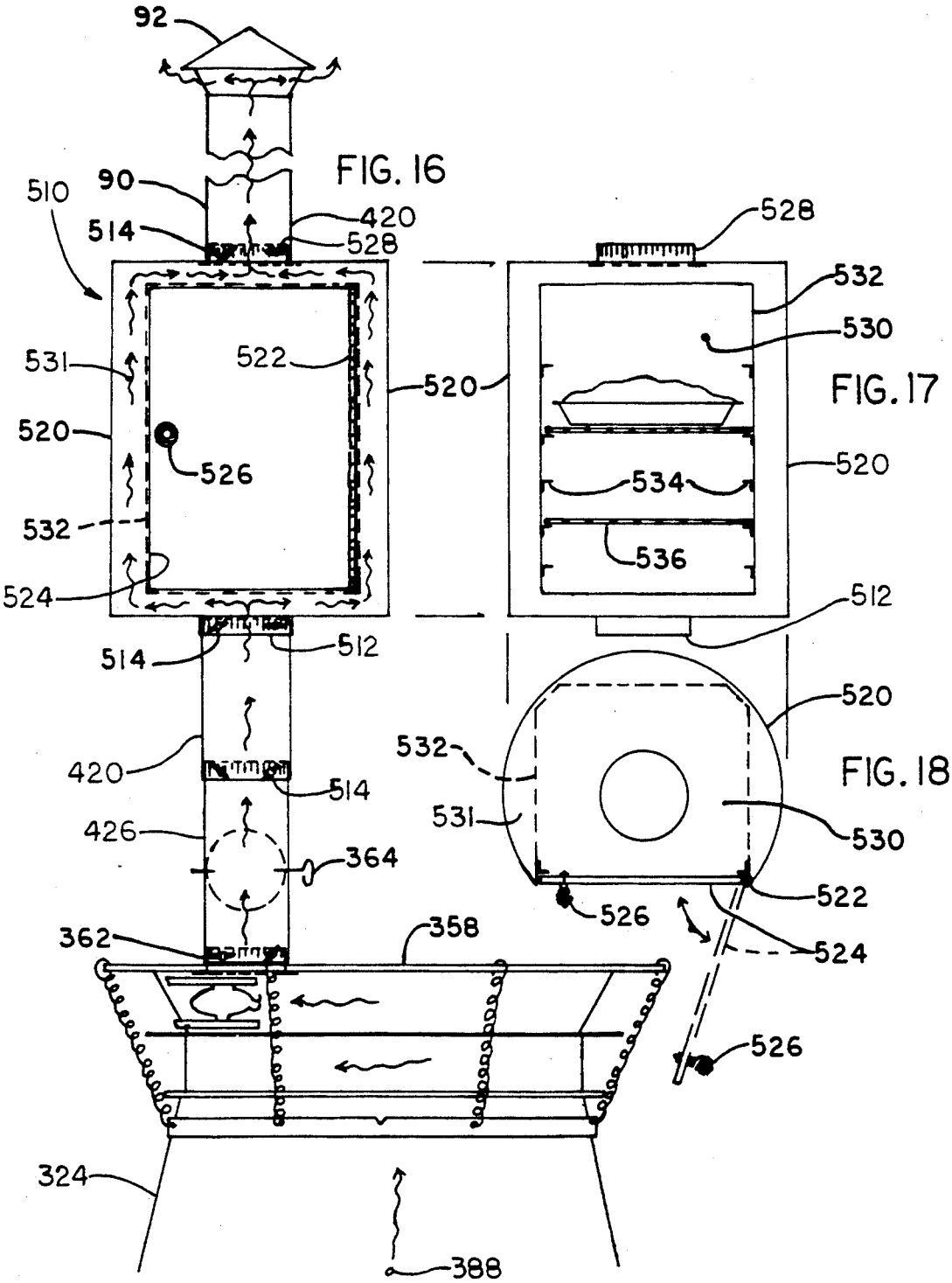
FIG. 16 is a front view of an oven attachment.
FIG. 17 is a front view of the oven attachment of FIG. 16 with the internal baking compartment exposed.
FIG. 18 is a cross-sectional view of the oven attachment of FIGS. 16 and 17.

To take further advantage of the heated rising gases, the stovepipe 90 can be fitted with an oven compartment attachment 510 via upper and lower connector rings 512 and quick release winged screws 514, as illustrated in FIGS. 16 through 18. The oven compartment has a circular cross-section bounded by housing 520. A door 524 hinged at 522 closes off the oven compartment. Coiled wire handle 526 permits opening and closing of the door. The inner baking compartment 530 shown in phantom is bounded by the inner compartment wall 532. Heat for baking is provided by hot flue gases rising in the cavity formed between the inner compartment wall 532 and oven compartment housing 520. The flue gases converge in the cavity above the inner baking compartment and exit the stovepipe 90 at the cap 92. The inner baking compartment walls 532 are fitted with adjustable baking rack supports 534. Baking racks 536 slide horizontally along the rack supports.

Figure 19:
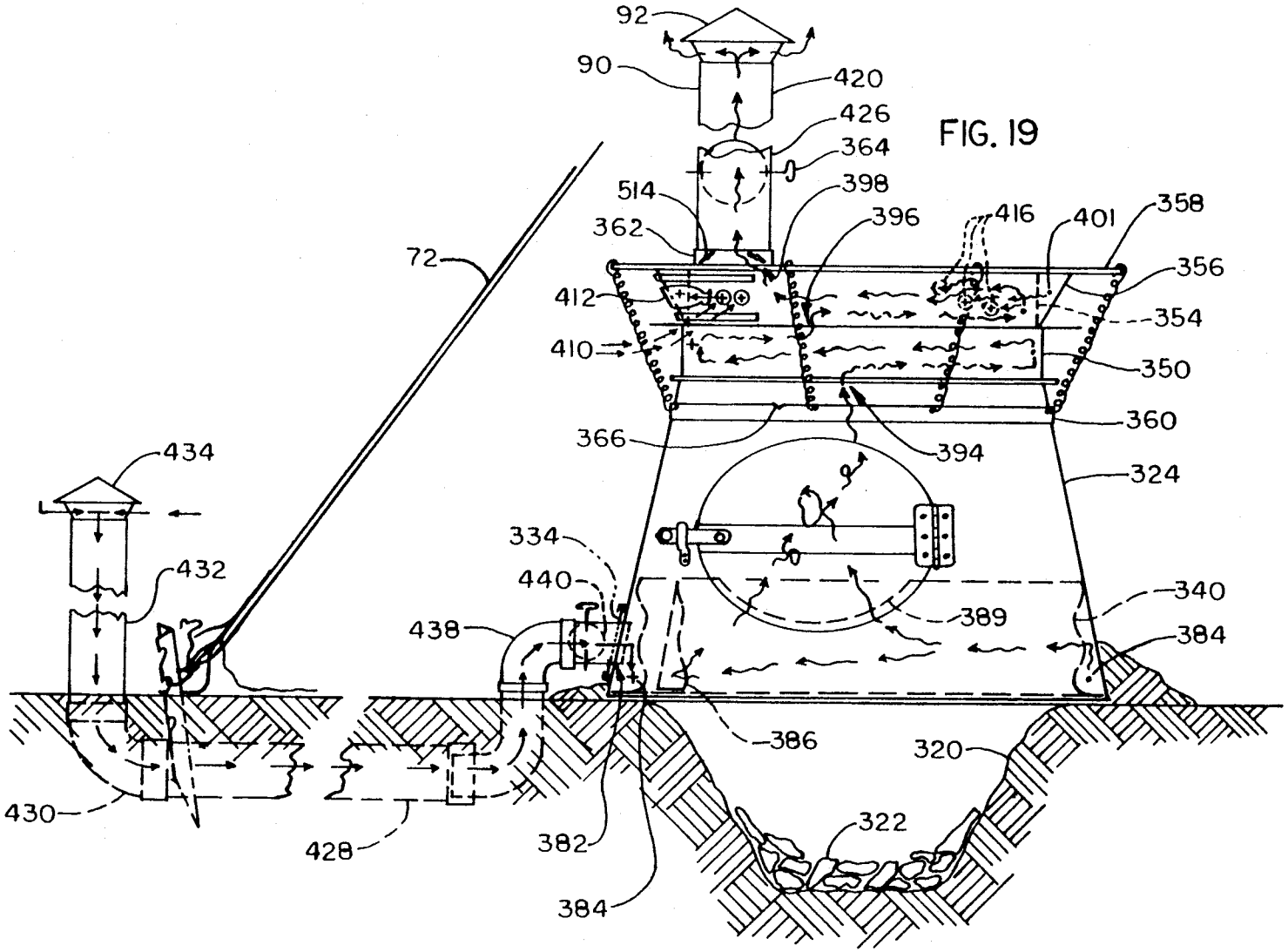
FIG. 19 is a side view of the stove and exterior air intake pipe.

The means and manner in which exterior air is taken in from the environment in a preferred embodiment is depicted in FIG. 19. In order to achieve a stable, warm atmosphere inside the lodge or tent, fresh air for the fire is drawn from the exterior of the lodge or tent, and by so doing, prevents the formation of a cold air layer on the ground inside. To accomplish this, pipe 428 is laid underground, and is buried so that about 2 inches of dirt covers it. In the depicted embodiment, the pipe has a diameter of 3 or 4 inches, and for a 20-foot diameter lodge, the pipe is 8 feet long in order to point the pipe then protrudes up out of the ground by means of 90-degree elbow section 430. Vertical section 432 has a raincap 434 to prevent rain and snow from entering the air intake pipe.

The other end of pipe 428 enters primary air preheater channel 384 at the primary air inlet 382. See also FIG. 4. Specially made section 438 is used to connect the pipe to the stove. Section 438 is provided with butterfly-type air flow control valve 440 to permit adjustment of air intake. This specially-made section is the only piece that must be manufactured for the system. Otherwise, just about any type of pipe will do. For example, at least a portion of the pipe can be composed of tin cans that are laid adjacent to one another in a trench or, where necessary, taped together, the elbow being formed by fitting a can vertically over a can laying horizontally. In an alternative embodiment, when necessary or desired for light travel, a pipe structure can be totally eliminated, whereby a trench, about 6 inches by 6 inches, is dug and then straddled with a series of small, 8-inch wood sticks. A layer of grass and then a layer of dirt is supplied to seal the trench tunnel and make a level floor. The trench opening outside the lodge is protected from rain or snow by simply making a small tepee frame of sticks and covering it with a waterproof fabric.

Vertical section 432 protrudes out of the ground for about 3 feet in the depicted embodiment, in order to prevent the possibility of its being covered by snow. Of course, if the average snowfall is less than 3 feet, this height is reduced accordingly. At any rate, if snow accumulates to a level above cap 434, it must be cleared away.

Figure 20:
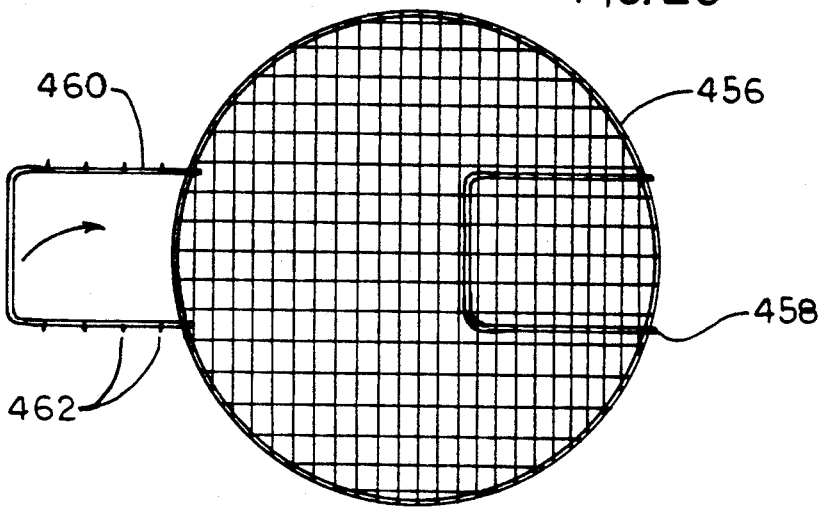
FIG. 20 is a plan view of a grill.
Figure 21:
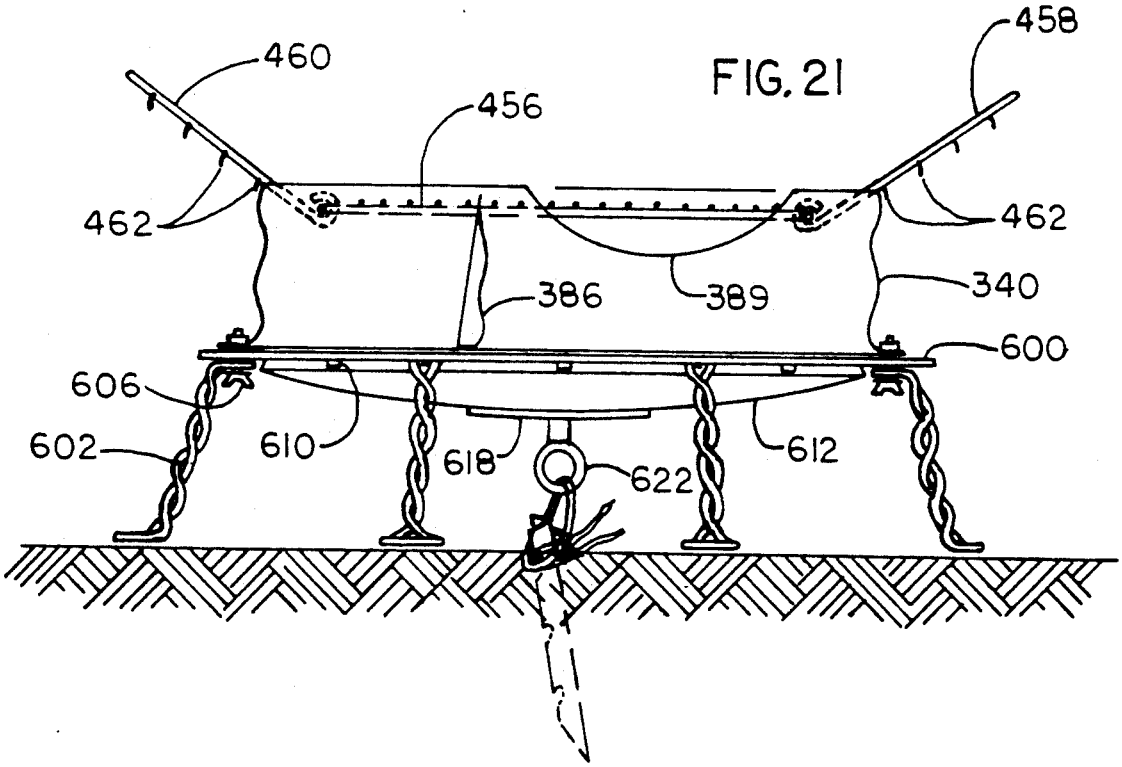
FIG. 21 is a side view of the grill of FIG. 20 and the stove's bottom and legs.

A grill adapted for use in the present invention is depicted in FIGS. 20 and 21. Grill 456 is added for barbecuing and roasting by removing plates 348, 352, and 358, and rims 350 and 354 by unhooking connecting springs 370. See FIG. 1. Grill 456 is then placed into the top opening of the main body or on top of the primary air preheater channel 384.

The round wire mesh grill has two lifting handles 458, 460 that fold inward and lie flat for storage. The handles are made with a series of prongs 462 welded to them which are used to hook onto the uppermost edge of the stove, serving to support the grill and promote adjustment of its height above the coals, thereby contributing to the regulation of temperature.

Also illustrated in FIG. 21 is the embodiment which has the legs attached. The six legs 606, which are twisted strands of steel, are attached equidistantly around the stove to the stove's main body at 600 via wing nut 606. The legs protrude out at about a 13 degree angle which helps to stabilize the stove preventing easy tip over hazard. FIG. 21 also illustrates the further securing of the stove by a steak driven into the ground and connected to the stove's ring at 622.

Figure 23:
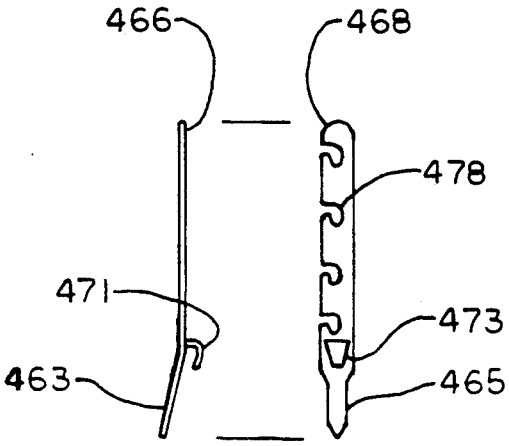
FIG. 23 is front and side views of the spit supports of FIG. 22.
Figure 22:
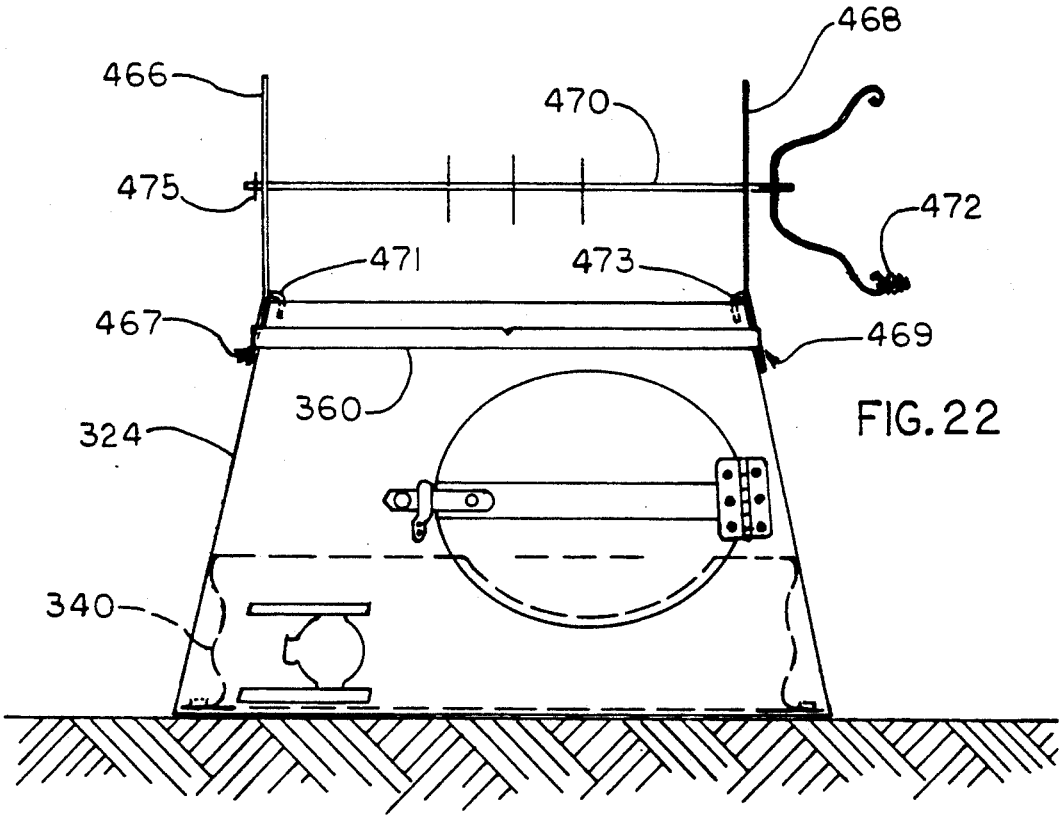
FIG. 22 is a front view of a roasting spit with associated spit supports.

FIG. 22 depicts roasting spit 470. The spit is made by attaching two adjustable spit supports 466, 468 to opposite portions of the uppermost edge of main body 324. As shown in FIG. 23, tongues 463, 465 of each spit support fit into slots 467, 469 provided in reinforcement ring 360 and catch at hooks 471, 473 to stabilize the spit supports against the main body. A spit 470 is inserted through supports 466, 468 and rests in support slots 478. Pin 475 assists in preventing the spit from dislodging from the spit support slots. Handle 472 serves to rotate the spit.

A smokestack assembly is depicted in greater detail in FIG. 19. Stovepipe 90 in the depicted embodiment is made of a 5-inch diameter standard-size flue pipe that fits onto flange 362, which is in turn mounted in top plate 358. See also FIG. 1. The stovepipe is secured at its base by quick removal winged screws. The length of pipe 90 varies according to different requirements, and in case of use with a 20-foot diameter lodge, it is preferably six feet in length so that, in addition to the 20-inch high stove, it reaches a height of 7 feet, 8 inches. This is high enough so that the top of the stack protrudes safely beyond the height of the lodge's liner ceiling, yet remains at least 3½ to 4 feet from an point of the lodge's outer skin. The stack assembly should be nearly centered under lodge smoke hole so as to eliminate any fire hazard.

An additional safety feature and one which is necessary to assure an adequate safety margin is the stovepipe's cap 92. The cap as designed disperses the narrow column of hot air rising in the long straight pipe. The cap also acts as a spark-disintegrator to break up an large sparks that might otherwise escape. However, given the compound spiral flue through which any spark must travel, it is noted that the escape of sparks is not a likely possibility, especially when the stove is used prudently. By the time the hot gases reach the cap, they are cooled down considerably, the stove having extracted much of the heat.

There are some tents and applications where it would be necessary for the smokestack to protrude beyond the roof line, requiring the use of a specially insulated fabric flue collar. This would be according to the conventional manner of use of such collars and the necessary care would be required.

A short stovepipe, for example, a 6-foot pipe, need not have any other support, although it may be supported by a wire bracket attached to the lodge's center pole, as disclosed in Pritchett, U.S. Pat. No. 4,744,381.

In the depicted embodiment, pipe 90 is composed of 1-foot sections 420, each connected to another by pairs of sheet metal screws 514. See FIG. 16. For compact, convenient transport, the six sections are disassembled so that five of the sections stack together into one compact bundle. In one embodiment, the sections are carried in a water bucket wrapped in a cloth sack. One section 426 of the pipe is provided with standard butterfly valve draft control 364. In one embodiment, section 426 is adapted to be stowed, along with the cap, in the stove itself, and in a further embodiment the remainder of disjointed sections 420 are also stored in the stove.

Figure 24:
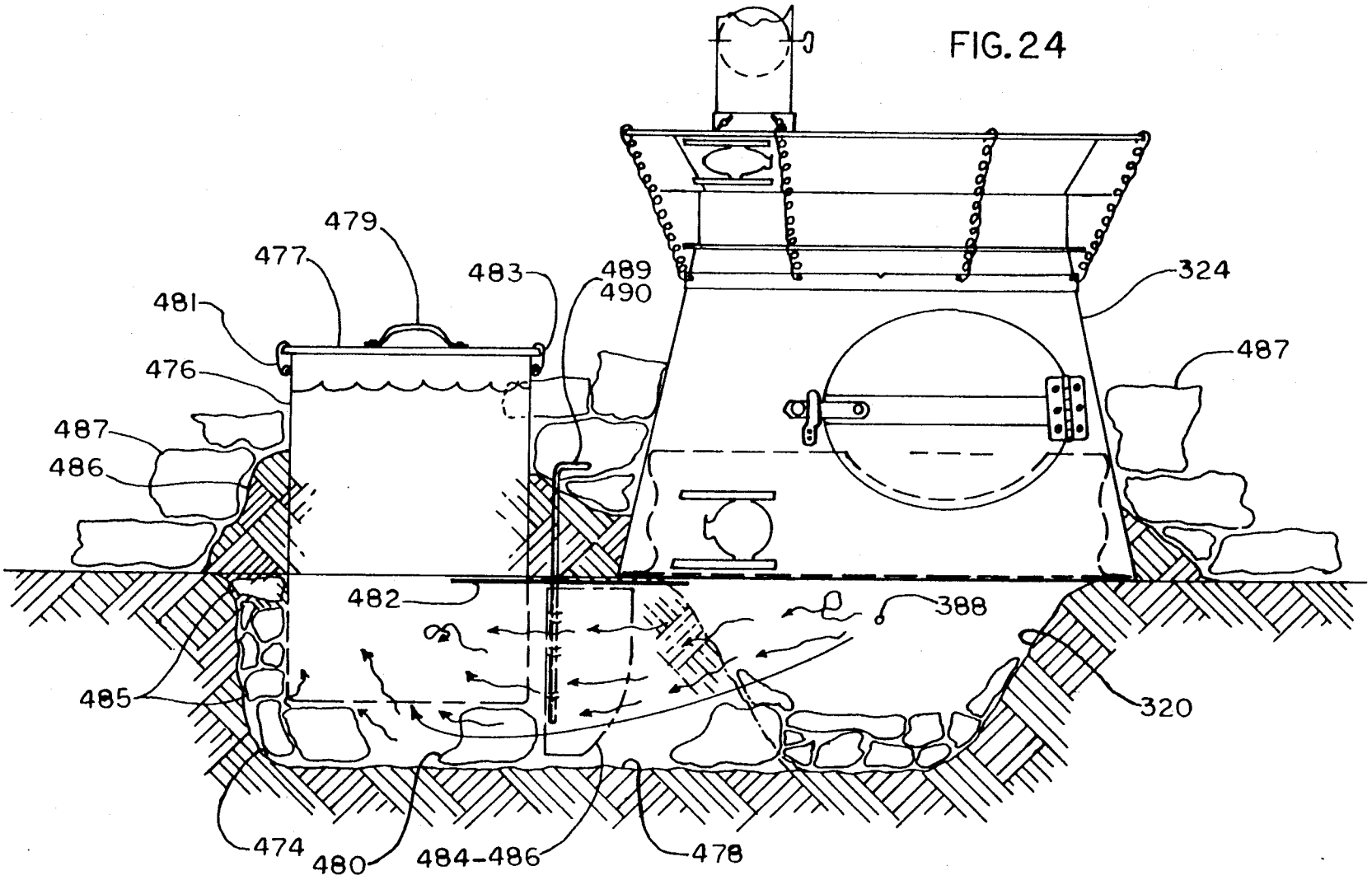
FIG. 24 is a front view of a hot water heating system with associated water bucket and water temperature control.
Figure 25:
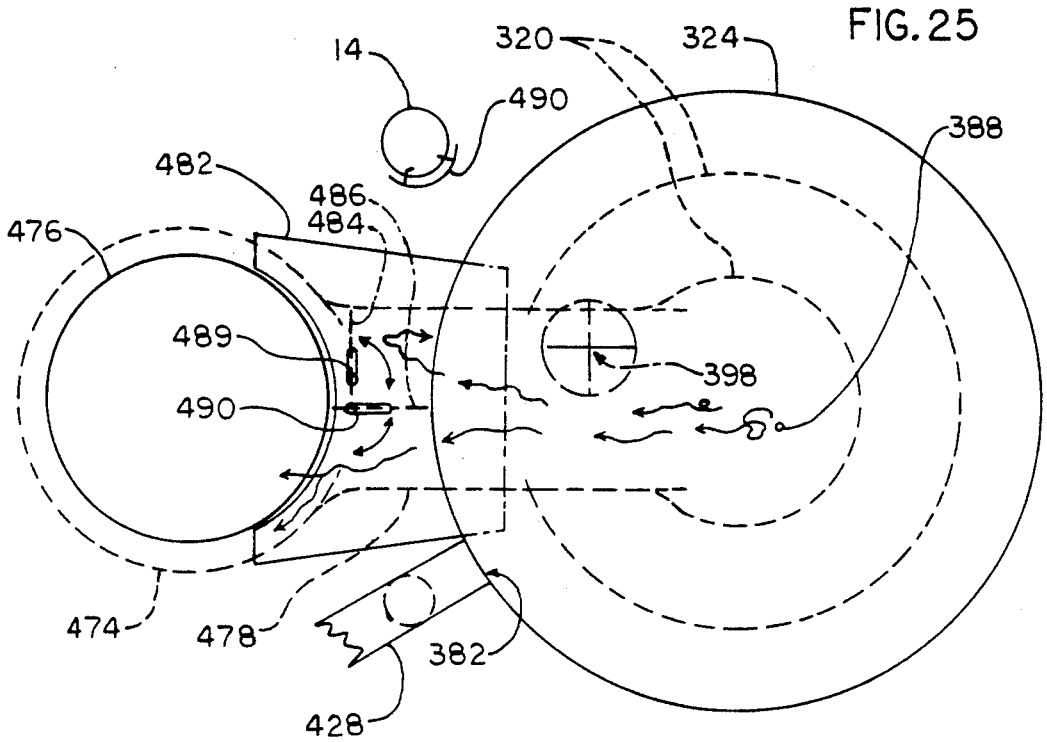
FIG. 25 is a plan view of the system of FIG. 24.

A hot water heating system is depicted in FIGS. 24 and 25. It is most convenient to have hot water available around a camp kitchen, and this system provides a simple yet effective hot water supply. As depicted in FIG. 24, another hole 474 is dug alongside ground pit 320 in order to accommodate water bucket 476. In the depicted embodiment, bucket 476 is a 5-gallon metal bucket, approximately 12 inches in diameter and about 14 inches high, with cover 477 and carrying handle 479. Retaining clips 481, 483 ensure the cover stays in place while heating water and when bucket is used in transport. Bucket-pit 474 is made about 14 inches wide and about 9 inches deep, the same depth as ground pit hole 320. An 8-inch trench 478 is then dug to connect the two pits. The water bucket is then placed in the bucket hole and sits on three or four rocks 480, the rocks having a height of about 3 inches. The rocks provide a space under the bucket through which hot air can flow. In the depicted embodiment, the bucket to stove clearance is two inches, and this clearance can be decreased towards zero in order to increase the warmth of the water. As depicted in FIG. 25, the stove is located about six inches away from the lodge's center pole 14, and pole heat reflective shield 490 is placed therebetween.

Metal connecting cover-plate 482 is laid over trench 478, snug against bucket 476 with the stove sitting on top of it. Small rocks 484 are then placed around the edge of the bucket. Rocks 484 prevent dirt from falling down around the bucket when dirt 486 is backfilled all around, over connecting cover-plate 482 and up the sides of the bucket to about six inches. The dirt is packed down a bit. The backfill covers all open cracks to achieve airtightness and also insulates the hot water bucket. Rocks 487 placed on top of the dirt surrounding the stove and brick help retain heat and may serve as convenient shelves.

The fire and the hot coals in the stove's primary combustion chamber radiate heat through connecting tunnel 478 to the bucket walls and underneath the bucket to heat the hot water. A great amount of heat is stored in the rocks, dirt and hot water. The water stays hot for quite a while and helps warm the lodge long after the fire is out.

Figure 26:
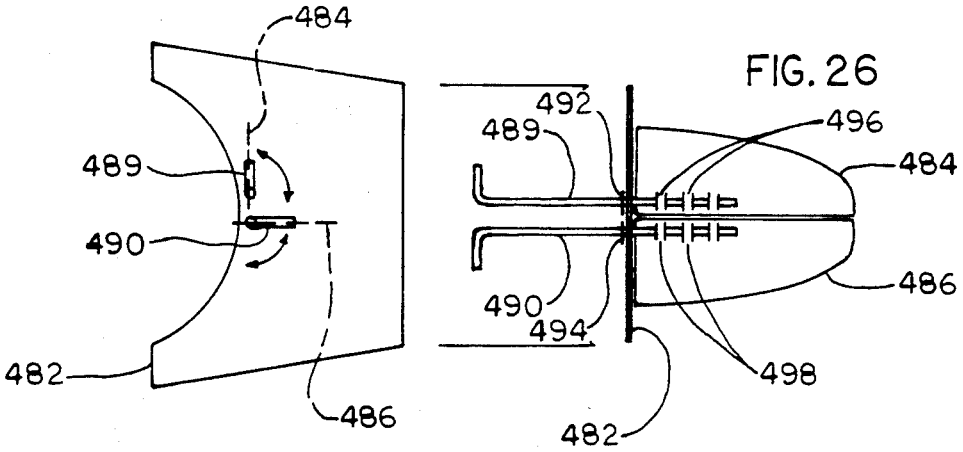
FIG. 26 is top and side views of the water temperature control valve.

FIGS. 24 and 25 illustrate how the amount of heat reaching the bucket via the connecting tunnel 478 can be adjusted. As water is being heated in the bucket, hot air from the stove's primary combustion chamber rushes past dual butterfly flaps 484, 486. Each butterfly flap is suspended in the connecting tunnel from rods 489, 490. The rods are held in place by retaining clips 492, 494 on the connecting cover-plate and fit into inserts 496, 498 on each butterfly flap, as shown in FIG. 26. Each butterfly flap may be rotated independently by turning a particular rod to widen or narrow the tunnel and thereby increase or decrease the space available to hot air to reach the bucket.

When intense fires are burned for long periods and to prevent the water from boiling away, a few more rocks are suitably placed in the tunnel entrance to deflect heat from the bucket. Hot water is dipped out when needed and the bucket is refilled from another container when necessary. The bucket is also used to stow away kitchen utensils and supplies during transportation.

The stove is very effective at extracting and releasing heat energy to the interior of the lodge. Main body 324, the compound flue chambers, as well as pipe 90 of the smokestack, i.e., all of the exposed metal surfaces, are used to radiate heat, as well as to conduct their heat to the surrounding air as the air flows over and around the stove's surfaces. Of special mention is the aesthetic and important feature of the compound flue chambers' plates 348, 352 and 358 which are adapted to increase the metal surfaces exposed by forming protruding, circular radiator fins. The heated ground is also a factor in the stove's ability to heat a lodge.

Plates 348, 352, 358 and rims 350, 354 are removed in one embodiment to offer a romantic fire light to a lodge while at the same time protecting the surrounding bedding, rugs, etc. from flying sparks, as well as preventing small children from accidentally contacting the fire. Of course, the entire stove can be removed easily, allowing the fire to be viewed directly, since the fire is already on the ground.

Figure 27:
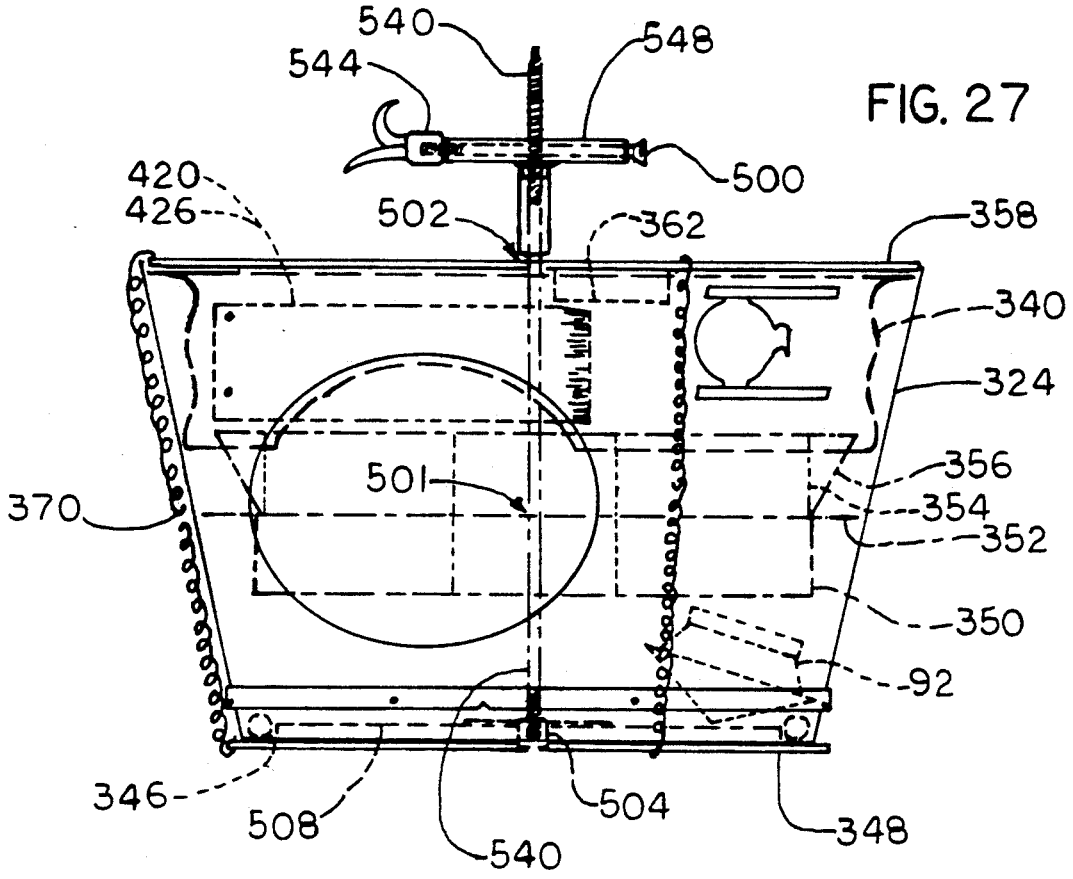
FIG. 27 is a front view of the stove of FIG. 1 compacted for transporting.

Another very advantageous feature of the design of the present stove is that it can be disassembled easily and all pieces can be neatly and compactly stowed away into main body 324 for transporting, as depicted in FIG. 27. As illustrated, there is plenty of room for storing away cooking or kitchen utensils wrapped in protective sacks. Dry kindling wood is also stowable in the stove or the stovepipe.

Figure 28:
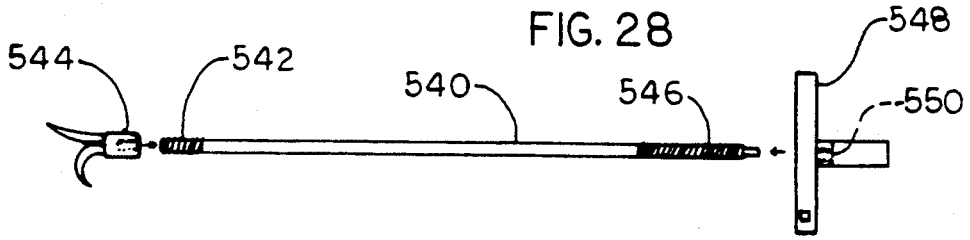
FIG. 28 is a front view of a poker accessory used with the stove.

To pack the stove, springs 370 are first disconnected to release plates 348, 352 and 358 and rims 350, 354. Plate 348 is left in place as top enclose of the main body 324, and plate 358 is used to enclose the bottom. Poker rod 540, illustrated in FIG. 28, is inserted into the screw coupling 504 via lower threads 542 so that the rod extends past the main body 324. Stovepipe cap 92 is placed on top of plate 348. Rim 350 and plate 352 are positioned below rims 354 and 356. The poker rod fits through hole 501 in plate 352 and beveled hole 502 in plate 358. Compacted stovepipe sections 420 fit inside primary air preheater channel 340. Then the six springs 370 are connected to make three longer springs which are then hooked to the top and bottom encloser plates in the holes provided, to hold the plates to the main body. A waterproof carrying sack is preferably provided to protect the stove from exposure to moisture, thus preventing rust during transport or storage.

Figure 29:
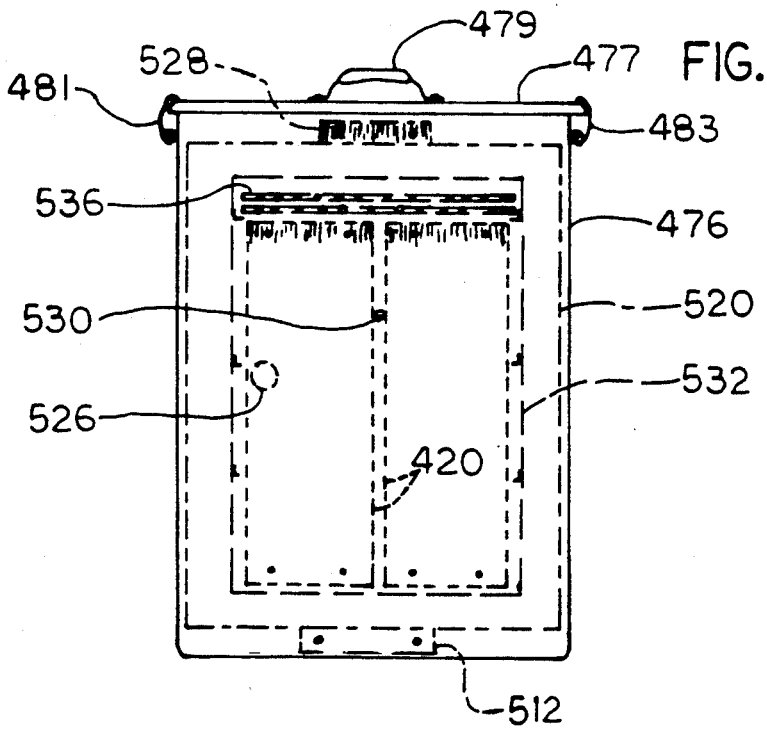
FIG. 29 is a front view of the water bucket of FIG. 24 carrying stove components for transport.

As illustrated in FIG. 29, the water bucket 476, cover 477 and handle 479 may also be used to store and carry several parts of the stove for transport. The water bucket is suitably sized to hold the entire oven attachment between connector rings 512 and 528. The inner baking compartment 432 holds several stove pipe sections 420 and baking racks 536. Retaining clips 481, 483 ensure that cover 477 is held in place securely during transport and storage.

Figure 30:
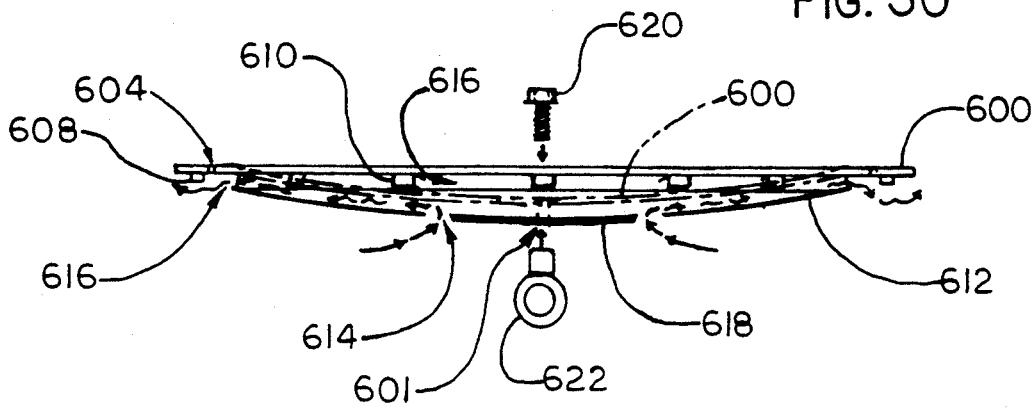
FIG. 30 is a cross-sectional view of the stove's base plate assembly in FIG. 2.
Figure 31:
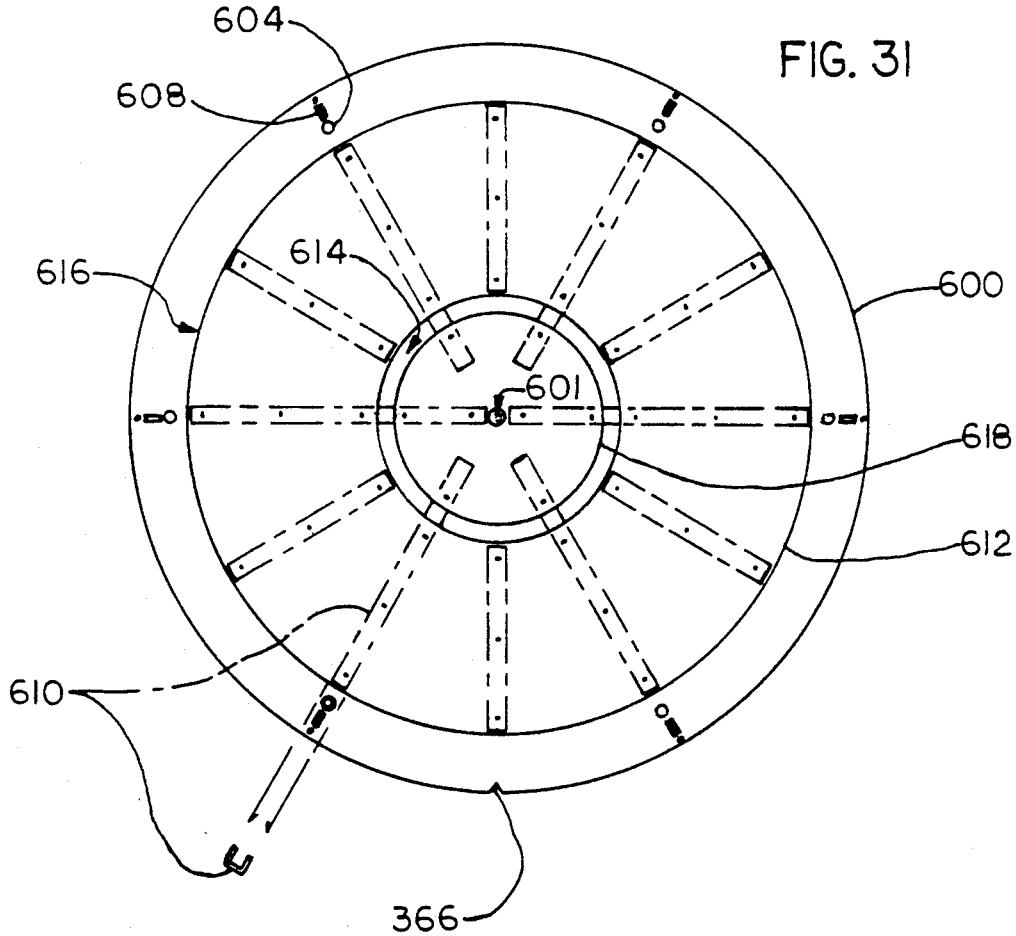
FIG. 31 is a bottom view of the base plate assembly in FIG. 30 with associated reinforcement bars in phantom, reinforcement plate and circular slot.

FIGS. 30 and 31 illustrate in greater detail an additional inventive feature of the present invention: the capacity for use of the stove with base plate 600 to enclose the main body 324 to allow primary combustion to occur within the stove. To hold the stove above the ground, six legs 602 (see FIG. 21) made of twisted, lightweight wire are secured to the base plate 600 at six ⅜-inch holes 604 equally spaced around its perimeter by six bolts, like quick removable winged bolt 606. Six studs 608 next to the holes 604 protrude underneath the base plate 600 and against each leg to prevent shifting and twisting of legs out of alignment. To further stabilize the stove, the legs stand 13 degrees from the vertical. The legs may also be used to support the primary air channel rim alone, as depicted in FIG. 21.

When heat is generated within the stove's primary combustion chamber, the base plate 600 may warp when subjected to very high temperatures. To provide additional strength and protection against the debilitating effects of the heat generated, U-channel iron bars 610 similar to those used to support bottom plate 348 are welded underneath the base plate 600. Sand or dirt may be used to cover the base plate and serve as insulation. As an added structural safeguard against warping, the base plate may be manufactured to have a concave shape.

With the heat being generated above ground, there may be concerns that the lodge floor, park grounds or tent floor may be damaged by heat radiating from the base plate. To minimize this radiation, a circular reflector plate 612 may be attached to the U-channel iron bars 610 via some fastening means like screws. Heat radiating from the base plate is reflected away from the floor by the reflector plate's concave surface. Fortunately, this reflected heat does not build up in the base plate. A circular slot 614 in the reflector area draws in cool air from below the stove. The cool air absorbs heat from the base plate area and flows out of air space 616, further enhancing the space heating capacity of the stove. Reflector plate 612 is supported similarly by circular reinforcement plate 618 to prevent warping. Bolt 620 passes through center hole 601 in the base plate 600 as well as through the reflector plate 612 and reinforcement plate 618 to secure these plates together beneath the base plate. Ringed screw nut 622 receives the bolt. The screw nut 622 also may be used to secure the stove to the ground by tying one end of a rope or strong cord to the ring and the other end to a stake and driving the stake into the ground as illustrated in FIG. 21.

Figure 32:
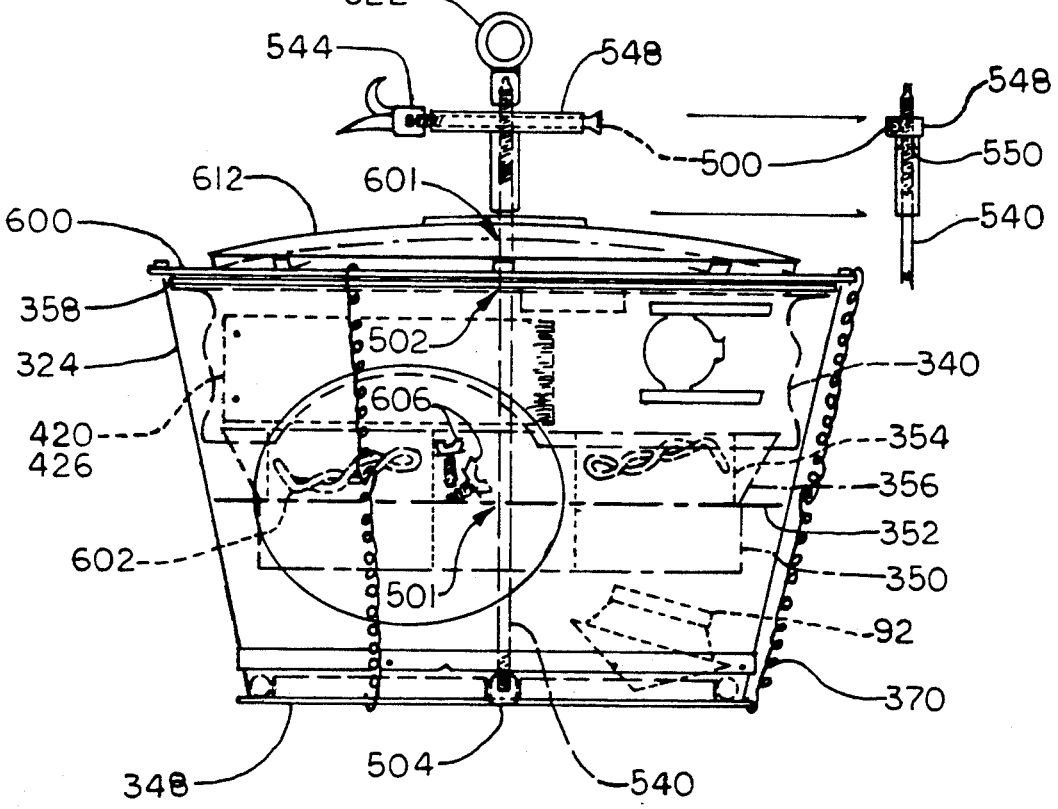
FIG. 32 is a front view of the stove of FIG. 2 compacted for transporting.

The stove with the base plate 600 remains easily dismantled and carried with many attachments stowed inside, as depicted in FIG. 32. The main body is enclosed between bottom plate 348 and base plate 600. Within the main body 324, the stovepipe cap 92 is located next to bottom plate 348. Rims 354 and 356 are stacked on top of rim 350 and middle plate 352. Quick removable winged bolts 606 and six legs 602 fit inside rim 354. Stovepipe section 420 lays horizontally within primary air preheater channel 340. Poker rod 540 is inserted into flue screw coupling 504, passes through center holes 501, 502 and 601 in middle plate 352, top plate 358 and base plate 600, respectively, and extends beyond the main body. Flue screw 502 is received by poker handle 548 and mates with poker point 544. Ringed screw nut 622 then screws onto the poker handle, forming the carrying handle for the dismantled stove.

The fundamental concept and design of the stove are adaptable to optimally suit many purposes. Different gauges and types of metals are usable to obtain the quality, weight, and durability desired. For example, when the stove is used in a tent or lodge, it is made in a range of sizes to suit the required heating and cooking needs of differently sized shelters. When used as a backpack stove, a smaller, simplified version is made—a lightweight, efficient and compatible wood stove that replaces the typical gas fuel stove now in use, avoiding the need to carry dangerous, heavy and costly fuel bottles. As a cabin or house stove, a larger, more elaborate stove is manufactured in heavier gauge metal with an enclosed, airtight bottom and legs. When increased durability is required, a fire-brick lining is added. Such a stove is airtight, efficient, clean-burning and has excellent heat-radiating capabilities, plus ample cooking surface. In this embodiment, a thermostat control mechanism is also an option.

I claim:

1. A portable camp stove comprising:

a generally frusto-conical main body defining a main combustion chamber;

an open bottom which allows for the placement of the stove over a fire in a pit in the earth;

means including at least one cylindrical section above said frusto-conical main body, forming a spiral flue chamber having an inlet in communication with said combustion chamber and an outlet, said spiral flue chamber containing at least one baffle that delays the escape of hot gases from said inlet to said outlet;

a corrugated metal divider, located at the bottom of said frusto-conical main body, which together with said frusto-conical main body forms a preheating chamber in which air traverses from an opening means in said frusto-conical main body and is preheated before the air enters the main combustion chamber through an opening means in said corrugated metal divider.

2. The stove of claim 1, wherein said spiral flue chamber includes at least one additional cylindrical section, forming a flue chamber, said additional cylindrical section comprising at least one baffle to delay the escape of hot gases from said inlet to said outlet.

3. The stove of claim 1, further comprising a cooking surface disposed directly above said spiral flue chamber, said surface comprising at least one removable plate to allow for the placement of at lest one cooking container.

4. The stove of claim 1, further comprising a stovepipe for the removal of smoke and other particulates and gases from the combustion chamber, a first end of said stovepipe being connected to said spiral flue chamber at a top surface of said stove and a second end of said stovepipe holding a stovepipe cap.

5. The stove of claim 4, further comprising an oven chamber fitted into the stovepipe about halfway between said first and second ends of the stovepipe.

6. The stove of claim 1, wherein said frusto-conical main body defines an opening and wherein said stove further comprises a door for closing said opening.

7. The stove of claim 1, further comprising hollow metal tubing directly attached to a plate which serves as the ceiling of the combustion chamber, said tubing to allow for the passage of liquid therein in order to heat said liquid.

8. The stove of claim 1, wherein said frusto-conical main body defines an air inlet opening and said stove further comprises a second door for closing said air inlet opening, said air inlet opening door being located at the bottom of said conical body such that entering air traverses the pre-heating chamber.

9. The stove of claim 8, further comprising an air inlet pipe, connected to said air inlet opening, said pipe running underground and outside of a dwelling containing said stove in order to bring air into the preheating chamber.

10. The stove of claim 1, further comprising a water heating system, which comprises a container of water partially buried in ground next to the stove, a passageway connecting the container to heated air from the pit in the earth, and at least one baffle-like divider regulating the flow of said heated air to the container.

11. The stove of claim 5, further comprising a water heating system having a container of water partially buried in ground next to the stove, a passageway connecting the container to heated air from the pit in the earth, and at least one baffle-like divider regulating the flow of said heated air to the container.

12. The stove of claim 11, wherein said oven, container, stovepipe, cap, and flue chamber are sized such that said oven is storable in said container and said stovepipe, stovepipe cap, and flue chamber are storable within said conical body, and wherein said stove further comprises a fire poker adapted to be placed through a center of said body to act as a carrying handle for said stove when said oven, container, stovepipe, cap and flue chamber are so stored.

13. The stove of claim 1, further comprising a bottom plate with attached legs to allow said stove to be placed on a cabin or other dwelling floor, and house the fire completely within the conical body of the stove.

14. The stove of claim 13, wherein said bottom plate is concavely shaped to prevent warping, and wherein said stove further comprises, below said bottom plate, a circular heat reflecting plate with circular slots for cooling.

15. A stove comprising:

a generally frusto-conical main body;

means including a first cylindrical section, disposed above said frusto-conical main body, forming a substantially horizontal flue chamber, said horizontal flue chamber containing a bottom opening and a top opening, said top and bottom openings positioned, along with at least one vertically disposed gas deflecting baffle connected to stove plates which form the top and bottom of said cylindrical section, such as to form an indirect channel between said top and bottom openings;

means forming a second cylindrical section, disposed above said first cylindrical section, forming a second substantially horizontal flue chamber, said second horizontal flue chamber containing a bottom opening and a top opening, said bottom opening and said top opening positioned, along with at least one vertically disposed gas deflecting baffle connected to stove plates which form the top and bottom of said cylindrical section, such as to form an indirect channel between said top and bottom openings;

means forming a third cylindrical section, disposed concentrically around said first cylindrical section, said first and third concentric cylindrical sections forming a first air preheater channel via a substantially annular path formed by a first opening communicating with the interior of the frusto-conical main body, and a second opening communicating with the second flue chamber;

means forming a fourth cylindrical section, disposed concentrically around said second cylindrical section, said second and fourth concentric cylindrical sections forming a second air preheater channel via a substantially annular path formed by a first opening communicating with the first flue chamber, and a second opening communicating with an exterior environment.

16. A portable camp stove comprising:

a generally frusto-conical main body defining a main combustion chamber;

an open bottom which allows for the placement of the stove over a fire in a pit in the earth;

a corrugated metal divider, located at the bottom of said frusto-conical main body, which together with said frusto-conical main body forms a preheating chamber in which air traverses from an opening means in said frusto-conical main body and is preheated before the air enters the main combustion chamber through an opening means in said corrugated metal divider.

17. The stove of claim 16, further comprising a grill for cooking which rests upon said frusto-conical main body.

18. The stove of claim 16, further comprising a rotisserie for cooking which rests upon said frusto-conical main body.

* * * * *